US006564775B1

(12) United States Patent
Kikuta et al.

(10) Patent No.: US 6,564,775 B1
(45) Date of Patent: May 20, 2003

(54) FUEL DELIVERY PIPES

(75) Inventors: Hikaru Kikuta, Obu (JP); Shoichi Hagiwara, Obu (JP); Taro Hirabayashi, Obu (JP); Yoshihiro Sakuma, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 09/631,829

(22) Filed: Aug. 3, 2000

(30) Foreign Application Priority Data

| | | |
|---|---|---|
| Aug. 3, 1999 | (JP) | 11-220398 |
| Mar. 24, 2000 | (JP) | 2000-084996 |
| Apr. 4, 2000 | (JP) | 2000-102703 |

(51) Int. Cl.[7] ..... F02M 41/00
(52) U.S. Cl. ..... 123/456; 123/468; 439/130
(58) Field of Search ..... 123/468, 469, 123/470, 456; 439/130, 79, 80, 76

(56) References Cited

U.S. PATENT DOCUMENTS

| | | | | |
|---|---|---|---|---|
| 5,295,468 A | * | 3/1994 | Blessing et al. | 123/456 |
| 5,471,961 A | * | 12/1995 | McArthur et al. | 123/456 |
| 5,531,202 A | * | 7/1996 | Lorraine | 123/456 |
| 5,533,485 A | * | 7/1996 | Bronkal | 123/456 |
| 5,598,824 A | * | 2/1997 | Treusch et al. | 123/470 |
| 5,663,881 A | * | 9/1997 | Cook, Jr. | 701/104 |
| 5,718,206 A | * | 2/1998 | Sawada et al. | 123/470 |
| 5,735,247 A | * | 4/1998 | Tsuzuki et al. | 123/470 |
| 6,012,418 A | * | 1/2000 | Bodenhausen et al. | 123/70 |
| 6,062,200 A | | 5/2000 | Hofmeister | 123/470 |
| 6,227,170 B1 | * | 5/2001 | Koshiba | 123/456 |

FOREIGN PATENT DOCUMENTS

| | | |
|---|---|---|
| JP | 3-39194 | 6/1991 |
| JP | 4 263913 | 9/1992 |
| JP | 8 303319 | 11/1996 |
| JP | 10 184490 | 7/1998 |

* cited by examiner

*Primary Examiner*—Carl S. Miller
(74) *Attorney, Agent, or Firm*—Dennison, Schultz & Dougherty

(57) ABSTRACT

Injectors 105 (#1 to #3) are connected to a connector block body 130 and an external wiring connector 150 is formed on the connector block body 130. The external wiring connector 150 has external wiring independent connecting terminals 151 to 153 and an external wiring common connecting terminal 158. Wires are wound around wiring guides 158*a*, 161, 162, 165 to 170, 173, 174 and are hooked on wiring guides 163, 164, 171, 172, which wiring guides are provided in the connector block body 130. Wires 111 to 113 121 to 123 are installed without crossing each other between injector connecting terminals 101*a*, 102*a*, 103*a*, 101*b*, 102*b*, 103*b* of the injectors 105 and external wiring connecting terminals 151 to 153, 158.

28 Claims, 27 Drawing Sheets

FUEL DELIVERY PIPES

BACKGROUND OF THE INVENTION

1. Field of the Invention

The present invention relates to fuel injection systems for internal combustion engines and, more particularly, to fuel delivery pipes for delivering fuel to fuel injectors.

2. Description of the Related Art

An example of a known fuel delivery pipe is shown in FIGS. 33 and 34. As shown in FIG. 33, the fuel delivery pipe has a cylindrical main body 210 and a plurality of injector connecting portions 214 mounted on the main body 210. Further, as shown in FIG. 34, an injector 250 is connected to each of the injector connecting portions 214. Fuel is supplied into the main body 210 of the fuel delivery pipe and then to each injector 250.

The main body 210 is integrally formed of a synthetic resin or a composite of a synthetic resin and other materials. An external wiring connector 218 is integrally formed with the main body 210 and has a connecting terminal 236 to which a fuel injection signal is supplied by external wiring. An injector connector 280 is provided on each injector connecting portion 214 and has a connecting terminal 281. The connecting terminal 281 is connected to a connecting terminal 257 of each injector 250. The connecting terminal 236 of the connector 218 is connected to the connecting terminal 281 of the injector connector 280 by wires 260. The wires 260 are embedded or installed within the main body 210 by injection molding when the main body 210 is molded. Such a fuel delivery pipe in which wires 260 are installed within the main body by injection molding is disclosed, for example, in Japanese Patent Publication No. 3-39194 and Japanese Laid-Open Patent Publication No. 8-303319.

In this known fuel delivery pipe, the wires 260 have a tendency to become distorted as a result of the high molding pressure applied to the wires when the main body 210 is molded. The distortion of the wires 260 may result in wiring defects, such as breakage or short circuits or exposure of the wires 260 on the outer surface of the main body 210.

Japanese Laid-Open Patent Publication No. 10-184490 discloses a connector block for a fuel injector in which the wires are not installed by an injection molding process. The connector block has a plurality of injector connectors and an external wiring connector on the main body. Each of the injector connectors is adapted to be connected to a connecting terminal of the injector. Further, the connecting portion of each connector is adapted to be connected to the external wiring connector. The wires that connect the injector connector and the external wiring connector are embedded in a close relationship within a wire distribution enclosure.

However, in this known connector block, the wires cross or overlap each other within the wire distribution enclosure. Therefore, wiring defects may result, such as breakage or short circuits.

SUMMARY OF THE INVENTION

It is, accordingly, an object of the present teachings to provide improved fuel delivery pipes and wiring methods for the delivery pipes, which can reduce or substantially prevent wiring defects, such as breakage or short circuits.

In one aspect of the present teachings, fuel delivery pipes are taught that have a wire distribution enclosure for protecting wires that couple induction signals from an external source to the injectors. Wall-like wiring guides are preferably provided within the wife distribution enclosure. The wires may be wound around or hooked on the wire guides. Preferably, the wire guides may be disposed in a position to change the wiring direction of the wires. The wall-like wiring guides may partition the wire distribution enclosure into sections and the wires may be separately laid in each of the sections. Thus, the wires do not cross each other, thereby reducing or preventing wiring defects, such as breakage or short circuits.

Further, a surrounding wall may be provided to surround the wire distribution enclosure, and connecting terminals of the injectors may extend through the surrounding wall. The surrounding wall may have wire-receiving grooves for passing the wires through the surrounding wall. With such a construction, the wires can be installed within the wire distribution enclosure.

In another aspect of the present teachings, methods are taught for installing the wires without causing the wires to cross each other between an injector independent connecting terminal and injector common connecting terminals of the injectors and an external wiring common connecting terminal and external wiring independent connecting terminals of the external wiring connector. Preferably, such wire installation method include routing a single wire along a wire routing path, connecting the wire to the connecting terminals and removing or cutting out unnecessary or surplus portions of the wire to form a plurality of separate connections. In this case, the wire is routed along a wire routing path, thereby facilitating the wire installation, connection and removal operations. Auxiliary guides are preferably used in the routing step, thereby further facilitating the wire routing operation. The auxiliary guides are preferably not integral with the fuel delivery pipe.

Additional objects, features and advantages of the present invention will be readily understood after reading the following detailed description together with the accompanying drawings and the claims.

DETAILED DESCRIPTION OF THE INVENTION

Figure 1:
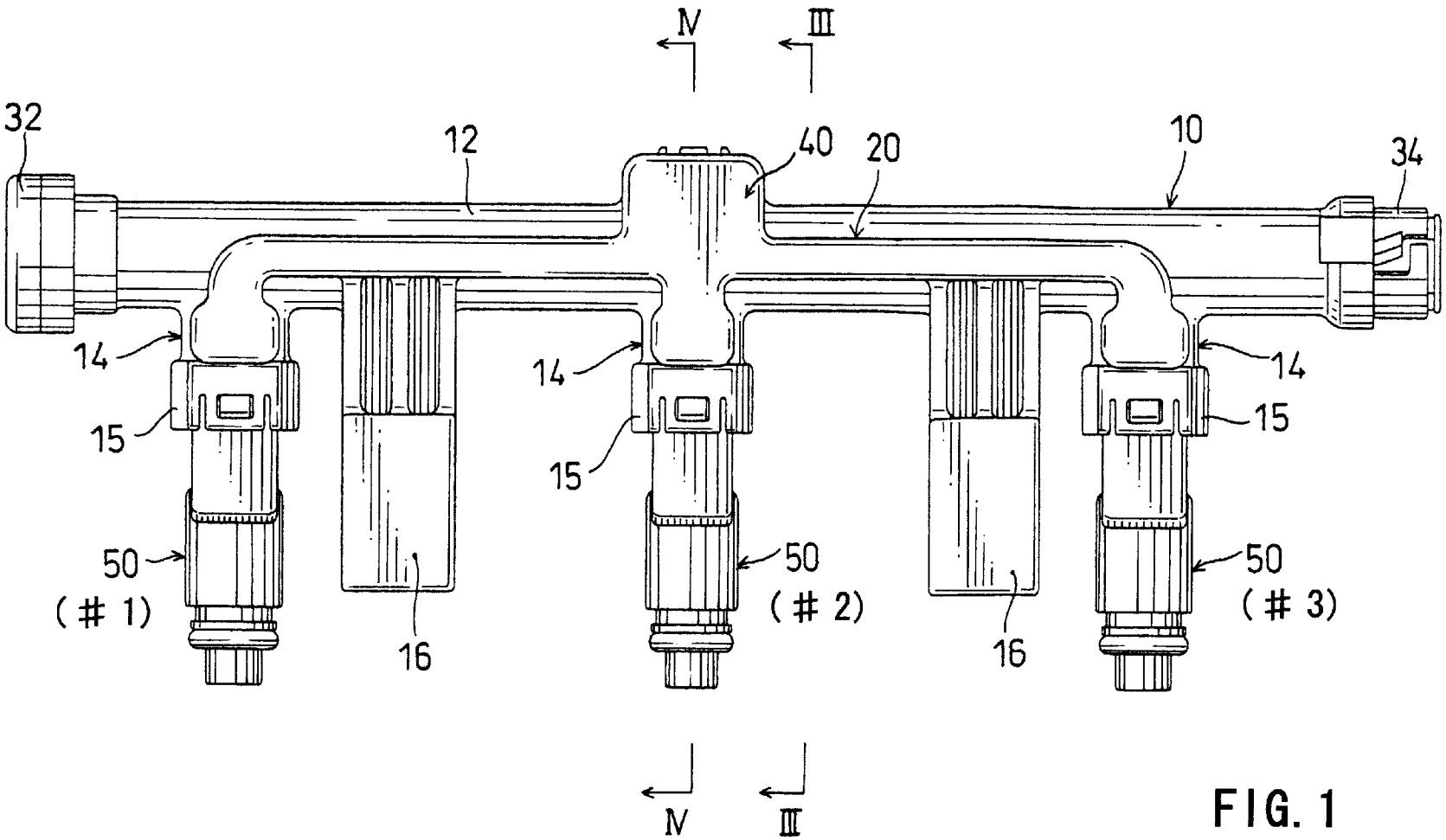
FIG. 1 is a front view of a first representative embodiment of an improved fuel delivery pipe.

According to the present teachings, wires for connecting the connecting terminals of fuel injectors to an external wiring connector are provided inside the fuel delivery pipe, which are also known in the field as fuel distributors or fuel rails. Such fuel delivery pipes may include a wire distribution enclosure adapted to retain and protect wires connecting an external source to the injectors. Wire guides are preferably provided within the wire distribution enclosure. During the wire installation process, the wires may be wound around or hooked on the wire guides. Preferably, the wire guides may be disposed in a position to change the routing direction of the wires, thereby facilitating the wire installation operation of the wires. In addition or in the alternative, the wiring guides may have walls that partition the wire distribution enclosure into sections and the wires may be separately laid in each of the sections. Thus, the wires can be wound around the wire guides or hooking the wires on the wire guides, or laid the wires separately in each of the sections of the wire distribution enclosure, which has been partitioned by the wire guides. As a result, the wires will not cross each other, thereby reducing or substantially preventing wiring defects, such as breakage or short circuits.

Further, a surrounding wall may be provided to surround the wire distribution enclosure, and the connecting terminals of the injectors may extend through the surrounding wall. The surrounding wall may have wire receiving grooves for passing the wires through the surrounding wall. With such a construction, the wires can be installed within the wire distribution enclosure.

In addition, methods are taught for installing the wires without causing the wires to cross each other. Preferably, a single wire is installed in a single continuous operation along a wire routing path through the injector independent connecting terminals and the injector common connecting terminals of the injectors and the external wiring common connecting terminal and external wiring independent connecting terminals of the external wiring connector. Subsequently, the wire is connected to the connecting terminals. Finally, unnecessary or surplus wire portions (i.e. portions of the wire other than the necessary wire portions) are removed or cut out. In this specification, the term "necessary wires" is intended to mean wires that electrically couple the external connector to the injector connecting terminals in order to supply induction signals from an external source to the injectors. Wires that are not intended for this purpose are called "unnecessary wires."

These methods facilitate the operation of installing the wires without causing the installed wires to cross each other. In addition, auxiliary guides preferably may be used in the routing step in order to thereby further facilitate the wire routing operation.

Representative examples of the present invention will now be described in further detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe some representative examples of the invention.

First Representative Embodiment

Figure 2:
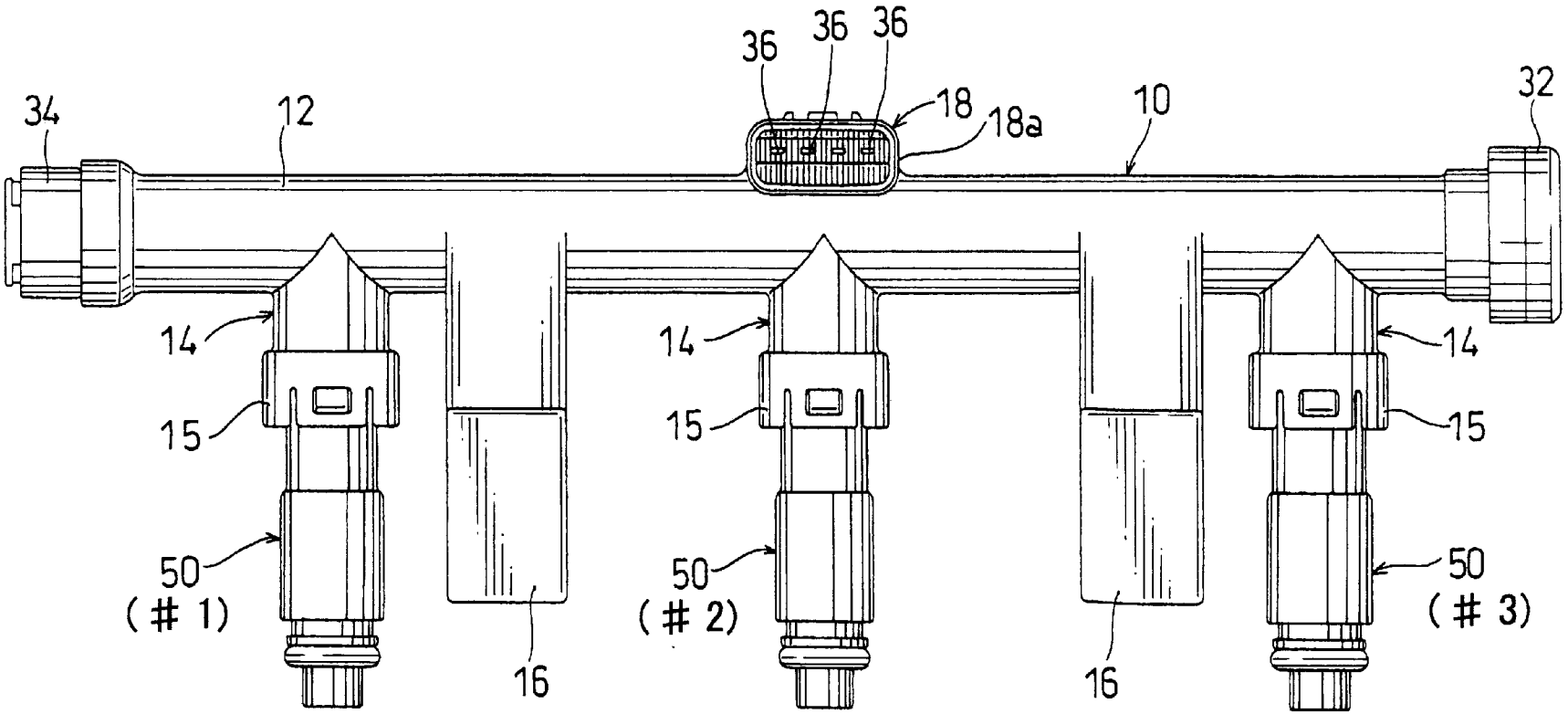
FIG. 2 is a rear view of the first representative embodiment.
Figure 3:
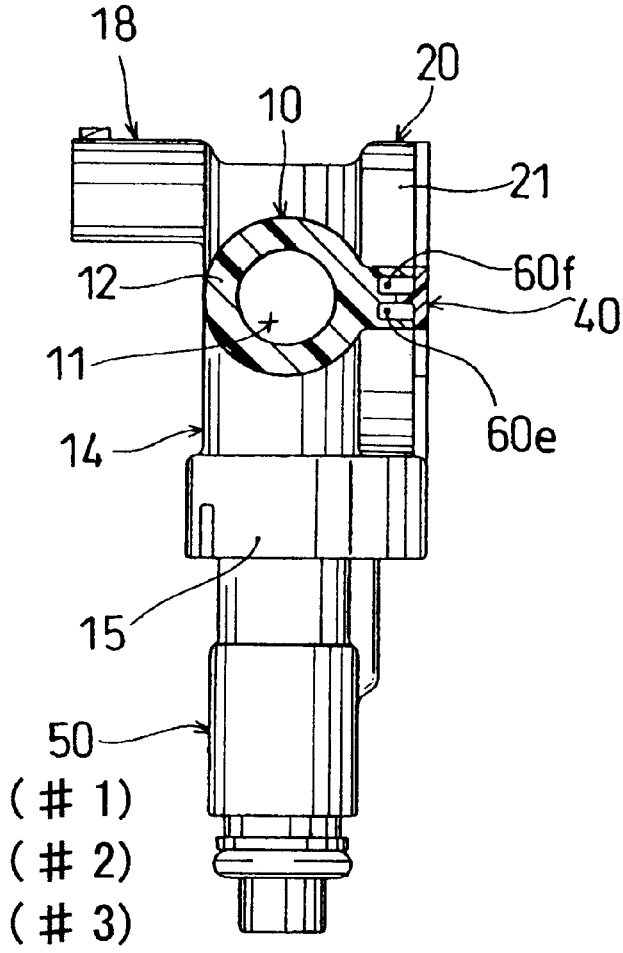
FIG. 3 is a sectional view taken along line III—III in FIG. 1.
Figure 4:
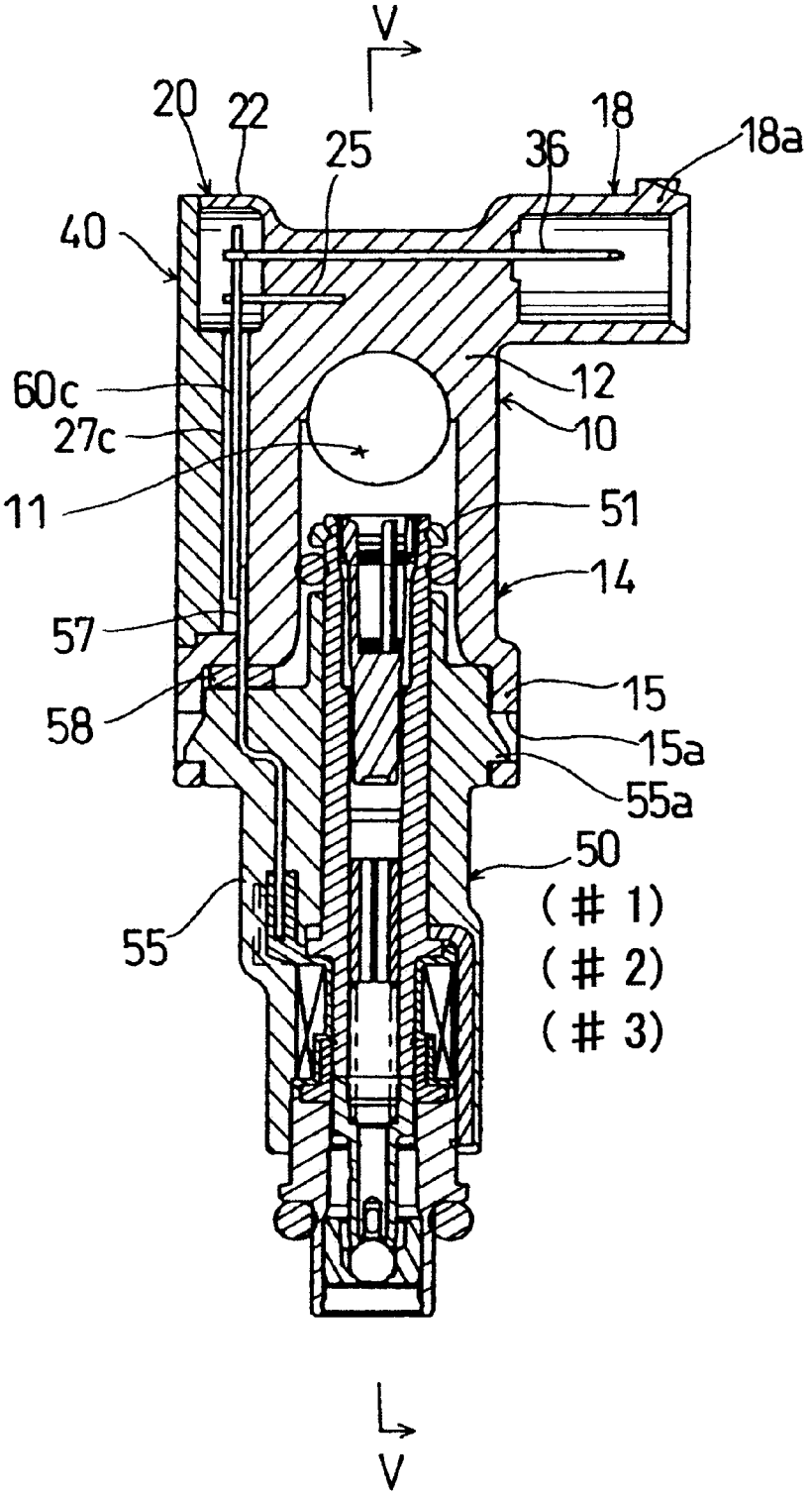
FIG. 4 is a sectional view taken along line IV—IV in FIG. 1.

A fuel delivery pipe of a first representative embodiment can be used, for example, in an in-line three-cylinder engine. FIG. 1 is a front view of the fuel delivery pipe; FIG. 2 is a rear view thereof; FIG. 3 is a sectional view taken along line III—III in FIG. 1; FIG. 4 is a sectional view taken along line IV—IV in FIG. 1; and FIG. 5 is a sectional view taken along line V—V in FIG. 4.

The fuel delivery pipe may include a main body 10 that is integrally formed, for example, of a composite resin into which a filler-type short fiber reinforcing material has been mixed. A polyamide resin, such as 66 nylon, is preferably used as the composite resin, and glass fiber is suitably used as the filler-type reinforcing material. A predetermined number of injectors 50 (three in FIG. 1) are connected to the main body 10. As shown in FIG. 2, a connector 18 is provided on the main body 10 and is connected to external wiring (not shown). A plurality of wires 60*a*–60*f* (see FIG. 8) are installed in the main body 10 and are connected between each of the injectors 50 and the connector 18. The injectors 50 are typically coupled to an engine intake manifold (not shown). A variety of known injectors and known engine intake manifolds may be utilized with the present teachings.

Figure 5:
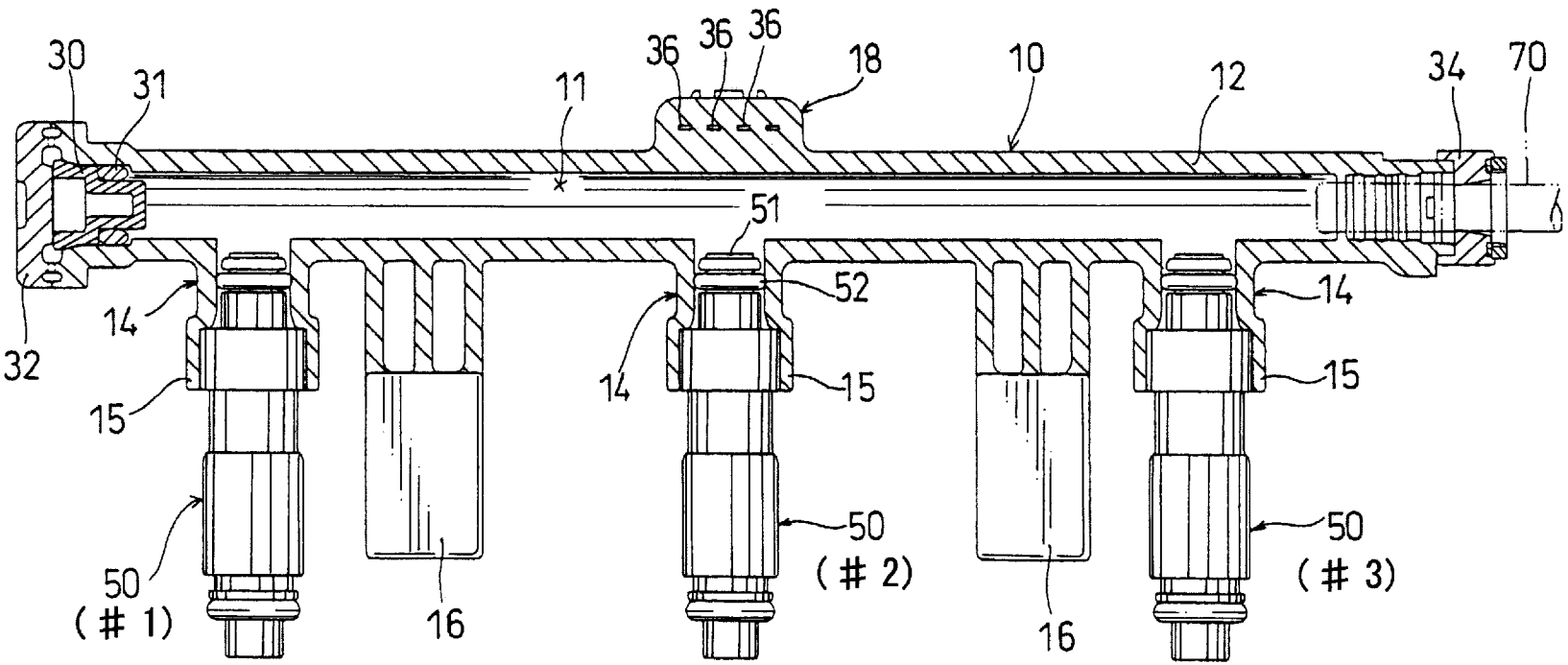
FIG. 5 is a sectional view taken along line V—V in FIG. 4.
Figure 6:
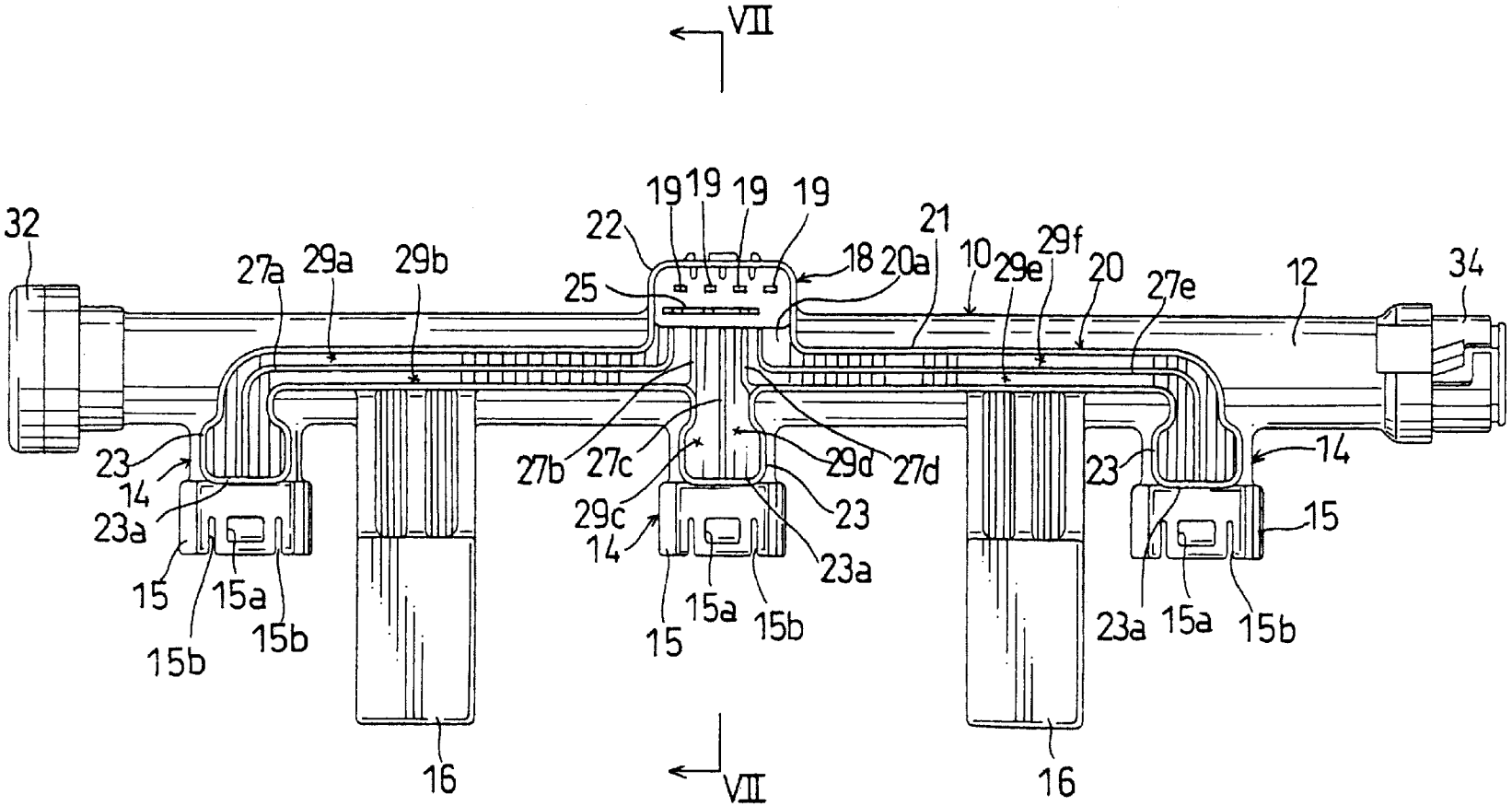
FIG. 6 is a front view of a main body of the first representative embodiment.

As shown in FIGS. 1 and 5, the main body 10 may include, for example, a body portion 12, three injector connecting portions 14, a pair of connecting bosses 16, an external wiring connector 18, a wire distribution enclosure 20, and a cover 40. The body portion 12 may be generally cylindrical. The three injector connecting portions 14 may be provided on the lower side of the body portion 12 and can connect to the injectors 50 (#1 to #3). The connecting bosses 16 may be provided between the injector connecting portions 14 in order to attach the fuel delivery pipe to a predetermined position of an engine (not shown) by bolts or other fasteners. The external wiring connector 18 preferably is provided on the upper side of the body portion 12 and above the riddle connecting portion 14. The wires 60*a*–60*f* (see FIG. 8) are laid in the wire distribution enclosure 20 and are connected between each of the injectors 50 and the connector 18. The cover 40 covers the wire distribution enclosure 20. FIG. 6 is a front view of the main body 10 and FIG. 7 is a sectional view taken along line VII—VII in FIG. 6.

Figure 7:
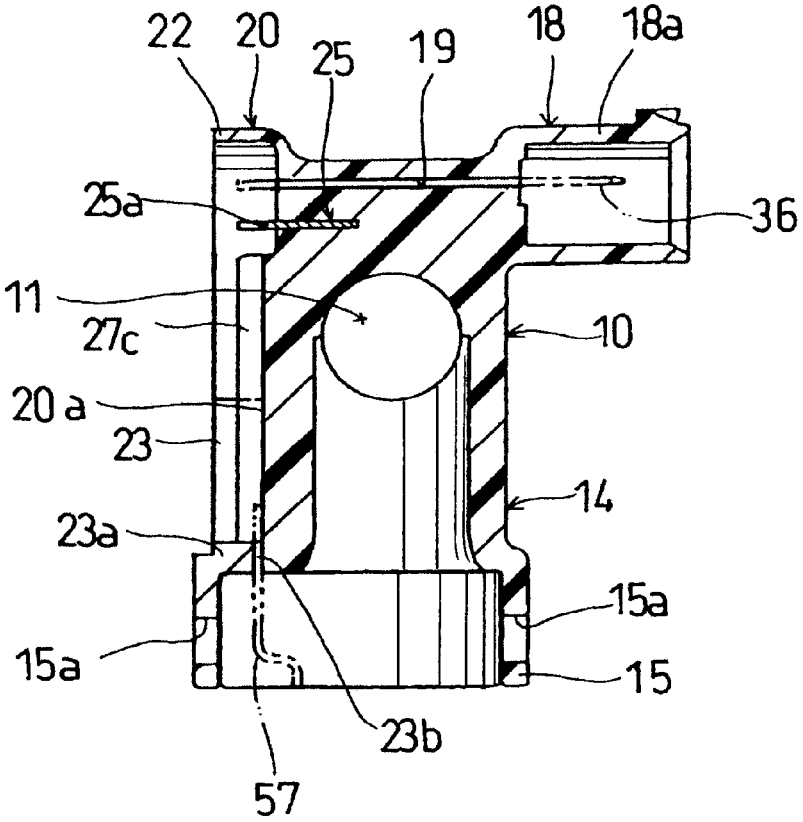
FIG. 7 is a sectional view taken along line VII—VII in FIG. 6.

As shown in FIG.7, each of the injector connecting portions 14 preferably has a generally cylindrical stepped configuration with an open bottom. A cylindrical portion 15 may be formed in the lower portion of the connecting portion 14. A pair of front and rear engagement holes 15*a* may be radially formed through the cylindrical portion 15. As shown in FIG. 6, slits 15*b* may be formed on both sides of the engagement holes 15*a* and extend upwardly from the lower end of the cylindrical portion 15. By providing the slits 15*b*, the diameter of the cylindrical portion 15 can be enlarged around the engagement holes 15*a* and thus the cylindrical portion 15 can radially expand.

As shown in FIG. 5, the body portion 12 and the injector connecting portions 14 may define a fuel passage 11 through which pressurized fuel is delivered to each injector 50.

As shown in FIG. 7, the external wiring connector 18 may be integrally formed in the middle of the upper portion of the main body 10 and may slightly protrude from the main body 10. The connector 18 may have a generally rectangular socket portion 18*a* with an open rear end.

As shown in FIGS. 6 and 7, the wire distribution enclosure 20 preferably has a surrounding wall 21 that extends forward of the main body 10 and forms a widthwise elongated rectangular frame. The surrounding wall 21 includes an upper wall portion 22 and lower wall portions 23. The upper wall portion 22 protrudes upwardly and substantially surrounds the front side of the external wiring connector 18. Each of the lower wall portions 23 protrudes downwardly and substantially surrounds the front side of the injector connecting portions 14. The front surface of the main body 10 within the wall 21 (or a bottom surface 20*a* of the wire distribution enclosure 20) is flat (see FIG. 7).

As shown in FIG. 7, the space within the upper wall portion 22 is positioned to correspond to the space within the socket portion 18*a* of the connector 18. Four holes 19 are formed in juxtaposition (as shown in FIG. 6) and extend transversely through the main body 10 between the space within the upper wall portion 22 and the space within the socket portion 18*a* of the connector 18.

As also shown in FIG. 7, a GND (grounding) terminal plate 25 is provided below the holes 19 and is press-fitted into the bottom surface 20*a* that is within the upper wall portion 22. Three U-shaped wire engaging grooves 25*a* are formed in the GND terminal plate 25 and engage ends of the wires 60*a*, 60*c*, 60*e*, which will be described below (see FIG. 10).

As shown in FIGS. 6 and 7, a lower end portion 23*a* of the lower wall portion 23 also serves as a stepped wall portion of the injector connecting portions 14. A pair of holes 23*b* (one of which is shown in FIG. 7) extend vertically through the lower end portion 23*a*.

As shown in FIG. 6, five partitions 27*a*–27*e* are preferably provided on the bottom surface 20*a* of the wire distribution enclosure 20 and partition the space within the surrounding wall 21 into six grooves 29*c*–29*f*. The middle partition 27*c* extends in a generally vertical direction from the lower end portion 23*a* of the middle lower wall portion 23 near the GND terminal plate 25 of the connector 18. Further, the partitions 27*b*, 27*d* are provided to the right and left of the middle partition 27*c* and extend in a generally vertically direction from the right and left side wall portions of the middle lower wall portion 23 near the GND terminal plate 25 of the connector 18. The partitions 27*a*, 27*e* are provided on the right and left portions of the bottom surface 20*a* and have a crank shape extending along the wall 21 from the lower end portion 23*a* of the right and left lower wall portions 23 near to the GND terminal plate 25 of the connector 18.

The partition 27*c* and the partitions 27*b*, 27*d* define vertically extending parallel grooves 29*c*, 29*d* in the center of the wire distribution enclosure 20. The partitions 27*a* and 27*b* define crank shaped grooves 29*a*, 29*b* that extend side by side along the partitions 27*a*, 27*b* in the left part of the wire distribution enclosure 20. Further, the partition 27*d* and the partition 27*e* define crank shaped grooves 29*c*, 29*f* that extend side by side along the partitions 27*d*, 27*e* in the right part of the wire distribution enclosure 20.

As shown in FIG. 5, after molding the main body 10, a sealing plug 30 is fitted into an opening of one end (the left end as viewed in FIG. 5) of the body portion 12 through an O-ring 31. A sealing cap 32 is then fixed to the end of the body portion 12, for example, by deposition. Further, a retainer 34 for a quick connector is mounted on an opening of the other end (the right end as viewed in FIG. 5) of the body portion 12.

Figure 8:
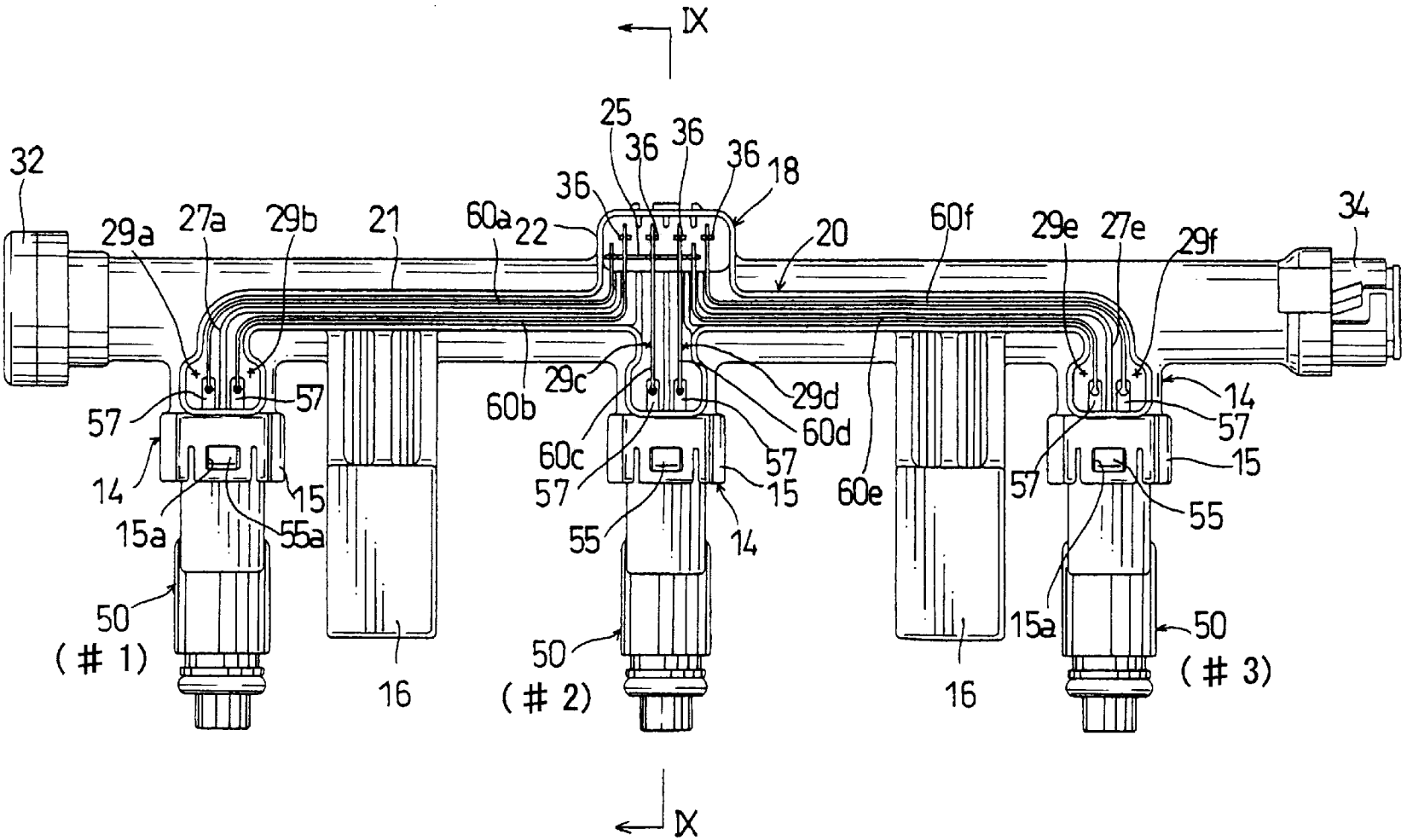
FIG. 8 is a front view of the main body with wires installed therein.
Figure 9:
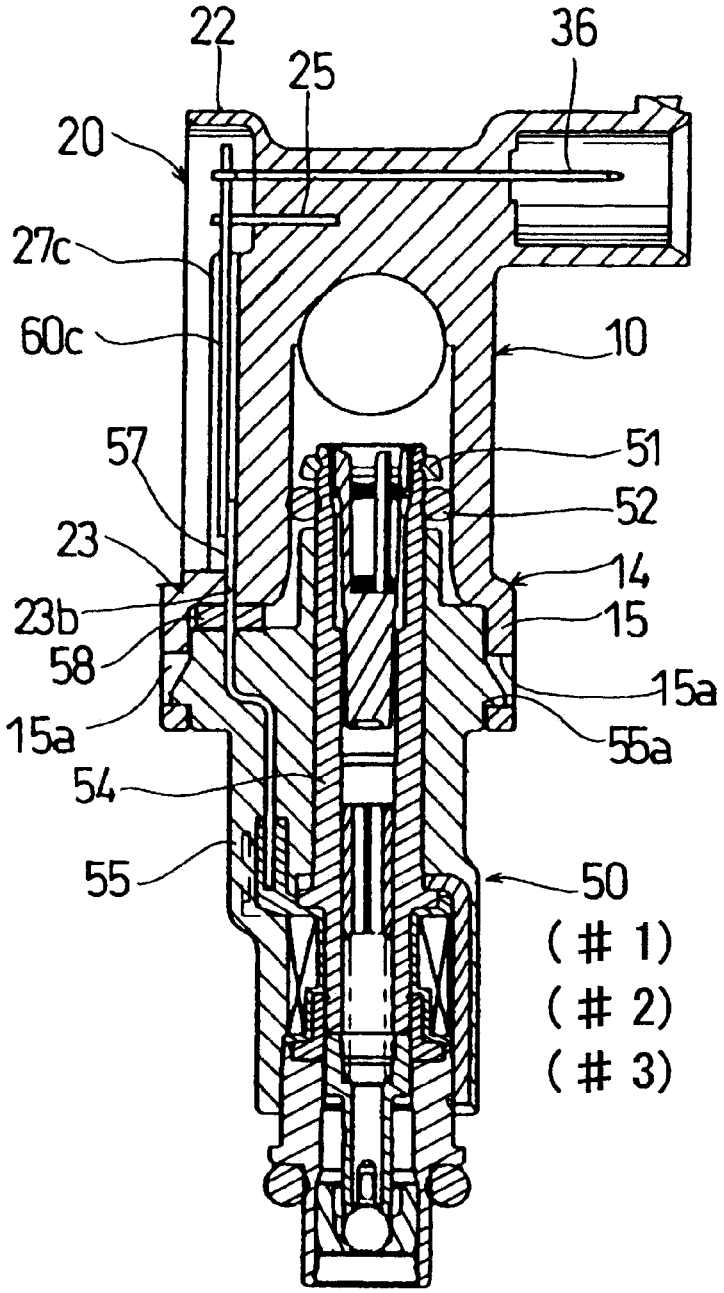
FIG. 9 is a sectional view taken along line IX—IX in FIG. 8.
Figure 10:
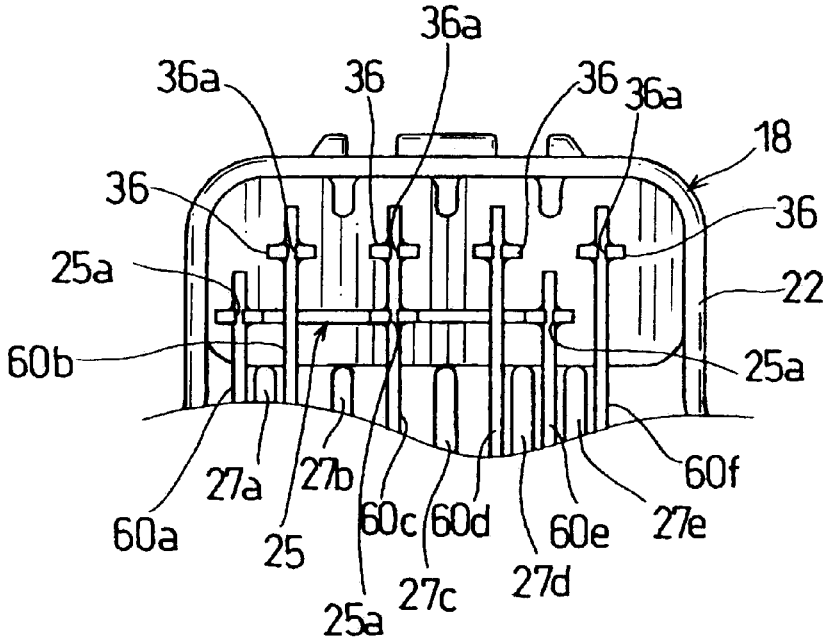
FIG. 10 is a front view of a portion around an external wiring connector.

As shown in FIGS. 8 to 10, four external wiring connecting terminals 36 may be inserted through the holes 19 (see FIG. 6) of the main body 10. A U-shaped wire engaging groove 36*a* is formed in one end of each external wiring connecting terminal 36 on the side of the wire distribution enclosure 20. The engaging grooves 36*a* receive the ends of the wires 60*b*, 60*c*, 60*d*, 60*f*. Of the four external wiring connecting terminals 36, the second one from the left in FIG. 10 is used as a common connecting terminal for grounding, and the remaining three terminals 36 are used as independent connecting terminals for coupling driving or induction signals to the injectors 50.

As shown in FIG. 9, a fuel supply side opening end 51 of the injector 50 is connected to the injector connecting portion 14 of the main body 10 by an O-ring 52. The cylindrical portion 15 of the injector connecting portion 14 receives a resin connector portion 55 fitted around a core 54 of the injector 50.

When the injector 50 is inserted into the injector connecting portion 14, a pair of engagement projections 55*a* formed in the outer surface of the connector portion 55 engage the engagement holes 15*a* due to elastic deformation of the portion of the cylindrical portion 15 in which slits 15*b* (see FIG. 6) are formed. Thus, the injector 50 can be readily connected to the injector connecting portion 14 by snap-fitting.

As shown in FIGS. 8 and 9, two injector connecting terminals 57 are provided in the connector portion 55 of each injector 50 and project upwardly. When the connecting terminals 57 are press-fitted into the holes 23*b* formed in the lower end portion 23*a* (see FIG. 6) of the lower wall portion 23 of the wire distribution enclosure 20, the distal end (upper end) of each connecting terminal 57 extends into the wire distribution enclosure 20. A packing or gasket 58 is disposed between the lower end portion 23*a* of the lower wall portion 23 and the connector portion 55 and around each connecting terminal 57. One of the two injector connecting terminals 57 (the left one in FIG. 8) is used as a common connecting terminal for grounding, and the other or right one is used as an independent connecting terminal for supplying driving or induction signals to the injectors.

Figure 11:
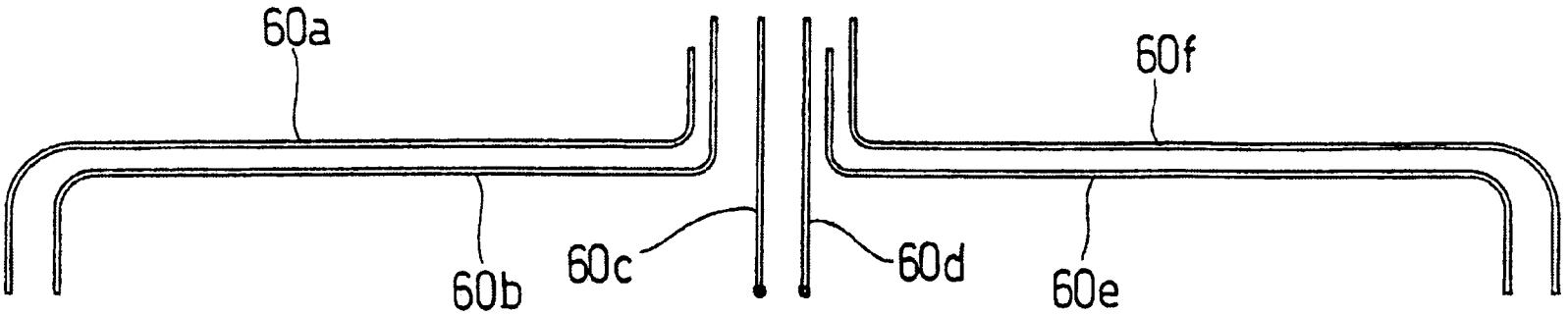
FIG. 11 is a front view of wires.

The wires 60*a*–60*f*, which will be described in further detail below, connect the four connecting terminals 36 and the GND terminal plate 25 to the connecting terminals 57 of each injector 50. As shown in FIG. 11, the wires 60*a*–60*f* comprise two short wires 60*c*, 60*d* disposed in the middle, two long wires 60*a*, 60*b* on the left, and two long wires 60*e*, 60*f* on the right. With respect to each pair of the wires 60*a* and 60*b*, 60*c* and 60*d*, 60*e* and 60*f*, the left wires 60*a*, 60*c*, 60*e* are used for grounding, and the right wires 60*b*, 60*d*, 60*f* are used for supplying driving or induction signals to the injectors.

As shown in FIG. 8, the wires 60*c*, 60*d* are laid within the vertical grooves 29*c*, 29*d* formed in the center of the wire distribution enclosure 20. The wires 60*a*, 60*b* are laid within the crank shaped grooves 29*a*, 29*b* in the left part of the wire distribution enclosure 20. The wires 60*e*, 60*f* are laid within the crank shaped grooves 29*e*, 29*f* in the right part of the wire distribution enclosure 20. The wires 60*a*, 60*b*, 60*e*, 60*f* may be formed to correspond to the crank configuration of the grooves 29*a*, 29*b*, 29*e*, 29*f*.

As shown in FIG. 10, the upper ends of the wires 60*a*, 60*c*, 60*e* for grounding are resistance welded or soldered in engagement with the wire engagement grooves 25*a* of the GND terminal plate 25. The upper end of the middle wire 60*c* is further resistance welded or soldered in engagement with the wire engagement groove 36*a* of the second connecting terminal 36 from the left. Further, the upper ends of the wires 60*b*, 60*d*, 60*f* for supplying driving or induction signals to the injectors are resistance welded or soldered in engagement with the wire engagement grooves 36*a* of the first, third and fourth connecting terminals 36 from the left, respectively.

As shown in FIG. 8, the lower ends of the wires 60*a*–60*f* are resistance welded or soldered to the associated injector connecting terminals 57 of the injectors 50.

Figure 12:
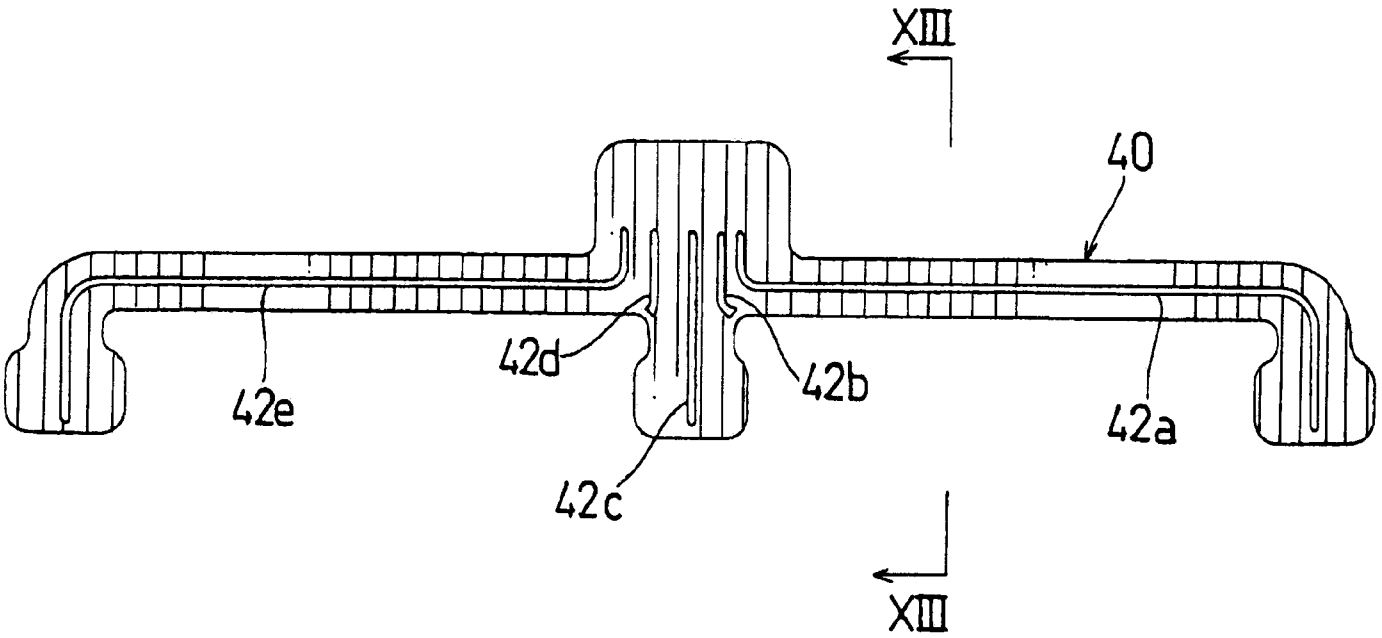
FIG. 12 is a rear view of a cover.
Figure 13:
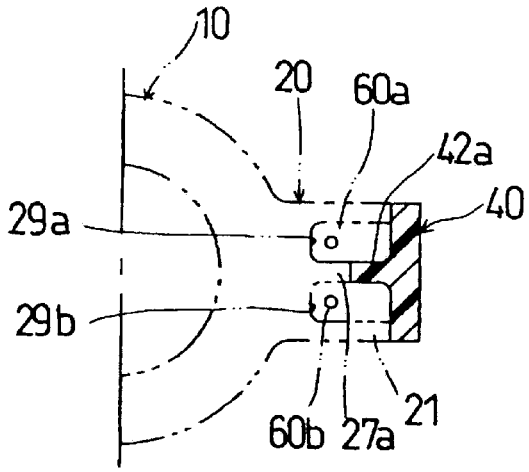
FIG. 13 is a sectional view taken along line XIII—XIII in FIG. 12.
Figure 14:
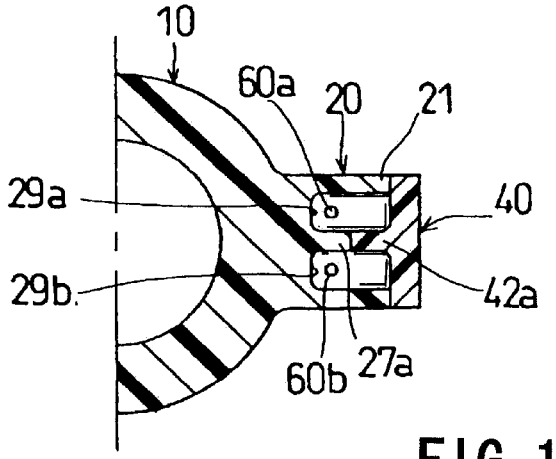
FIG. 14 is a partial sectional view showing a joint of the cover.

The cover 40, which will now be described in further detail, covers the wire distribution enclosure 20 in which the wires 60*a*–60*f* have been installed in the manner as described above. The cover 40 is shown in FIGS. 12 and 13. FIG. 12 is a rear view of the cover 40, and FIG. 13 is a sectional view taken along line XIII—XIII in FIG. 13. The cover 40 has a flat plate-like shape that generally has the same contour as the upper edge of the surrounding wall 21 (see FIG. 6) of the wire distribution enclosure 20.

As shown in FIG. 12, ribs 42*a*, 42*b*, 42*c*, 42*d*, 42*e* are formed to correspond to the partitions 27*a*, 27*b*, 27*c*, 27*d*, 27*e* of the wire distribution enclosure 20, respectively, on the back surface of the cover 40. The cover 40 preferably is integrally formed of the same resin material that is used for the main body 10. The ribs 42*a*–42*e* of the cover contact the partitions 27*a*–27*e* of the wire distribution enclosure 20. In this state, the outer periphery of the cover 40 is joined to the open end surface of the surrounding wall 21, for example, by adhesives or by deposition. Thus, the wire distribution enclosure 20 in which the wires 60*a*–60*f* have been installed is covered.

Thus, mounting the cover 40 on the main body 10 will complete the assembly of the fuel delivery pipe. Alternatively, the fuel delivery pipe may also be completed by filling the wire distribution enclosure 20 of the main body 10 with a potting resin. In this case, the same wire covering effect can be obtained.

Further, as shown in FIG. 5, a fuel supply pipe 70 (shown by a broken line) is easily inserted in a continuous motion into the right end opening of the main portion 12 through the quick-connector retainer 34.

Bolts or other fasteners may be utilized to attach the connecting bosses 16 to a predetermined position of the engine block (not shown). At this time, the wire distribution enclosure 20 is downwardly oriented. Further, fuel injection signals are supplied to a power supply connector (not shown) by external wiring, which power supply connector is connected to the external wiring connector 18 shown in FIG. 2.

As described above, in the fuel delivery pipe of this embodiment, the wires 60*a*–60*f* are installed in the wire distribution enclosure 20 of the main body 10 and the cover 40 covers the main body 10. Therefore, unlike known fuel delivery pipes, in which the wires 60*a*–60*f* are embedded or installed in the main body 10 by injection molding, high molding pressure is not exerted on the wires 60*a*–60*f*, thereby preventing the wires 60*a*–60*f* from becoming distorted by high molding pressure. As a result, wiring defects caused by high pressure molding, such as wire distortion, breakage, short circuits or exposure of the wires on the outer surface of the main body 10, do not occur. Further, the partitions 27*a*–27*e* of the wire distribution enclosure 20 can separate the wires 60*a*–60*f* from each other, thereby ensuring insulation of the wires.

Further, as described above in this embodiment, the connecting terminals 36 may be press-fitted into the connector 18. Therefore, unlike known fuel delivery pipes, in which the connecting terminals 36 are formed in the main body 10 by injection molding, high molding pressure is not exerted on the connecting terminals 36, thereby preventing the connecting terminals 36 from becoming distorted by high molding pressure.

Moreover, because the wires 60*a*–60*f* within the wire distribution enclosure 20 are connected to the injector connecting terminals 57 of the injectors 50, it is not necessary to provide terminals for the injector connectors, which are necessary if the injectors 50 are detachably connected to the fuel delivery pipe. Thus, the number of components and assembling man-hours can be reduced.

Figure 15:
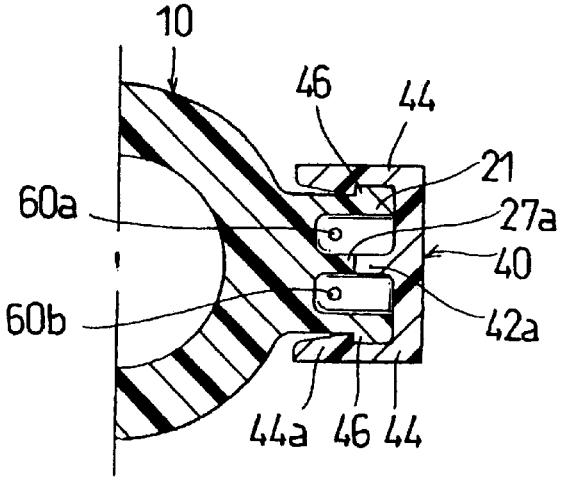
FIG. 15 is a partial sectional view showing another example of a joint of the cover.

The cover 40 may be snap-fitted on the surrounding wall 21 of the main body 10. For example, as shown in FIG. 15, at least two engagement pieces 44, each having an engagement claw 44*a*, may extend from the outer peripheral portion of the cover 40 and can elastically deform. An engagement claw 46 is formed on the outside surface of the wall 21 of the wire distribution enclosure 20 and can engage the engagement claws 44*a* of the cover 40. In order to attach the cover 40 to the wall 21 of the wire distribution enclosure 20, the cover 40 is pressed against die wall 21. At this time, the engagement claws 44*a* are elastically deformed and pass over the engagement claw 46, thus engaging the engagement claw 46. By thus snap-fitting the cover 40 to the wall 21, the cover 40 can be more readily attached to the main body 10 with a single motion as compared to the above representative embodiment in which the cover 40 is joined to the wall 21, for example, by adhesives or by deposition.

The present teachings are not limited to the constructions that have been described in the first representative embodiment, but rather, may be appropriately modified without departing from the spirit and scope of the invention. For example, while the first representative embodiment is a fuel delivery pipe for an in-line three-cylinder engine, the number of cylinders is not limited. Further, although each of the partitions 27*a*–27*e* is contiguous, the partitions may be discontinuous, for example, in the form of discontinuous walls or projections. Further, the wires 60*a*–60*f* may be formed of a conductor coated with an insulating material. In this case, it is not necessary to provide the partitions 27*a*–27*c*.

Second Representative Embodiment

Figure 16:
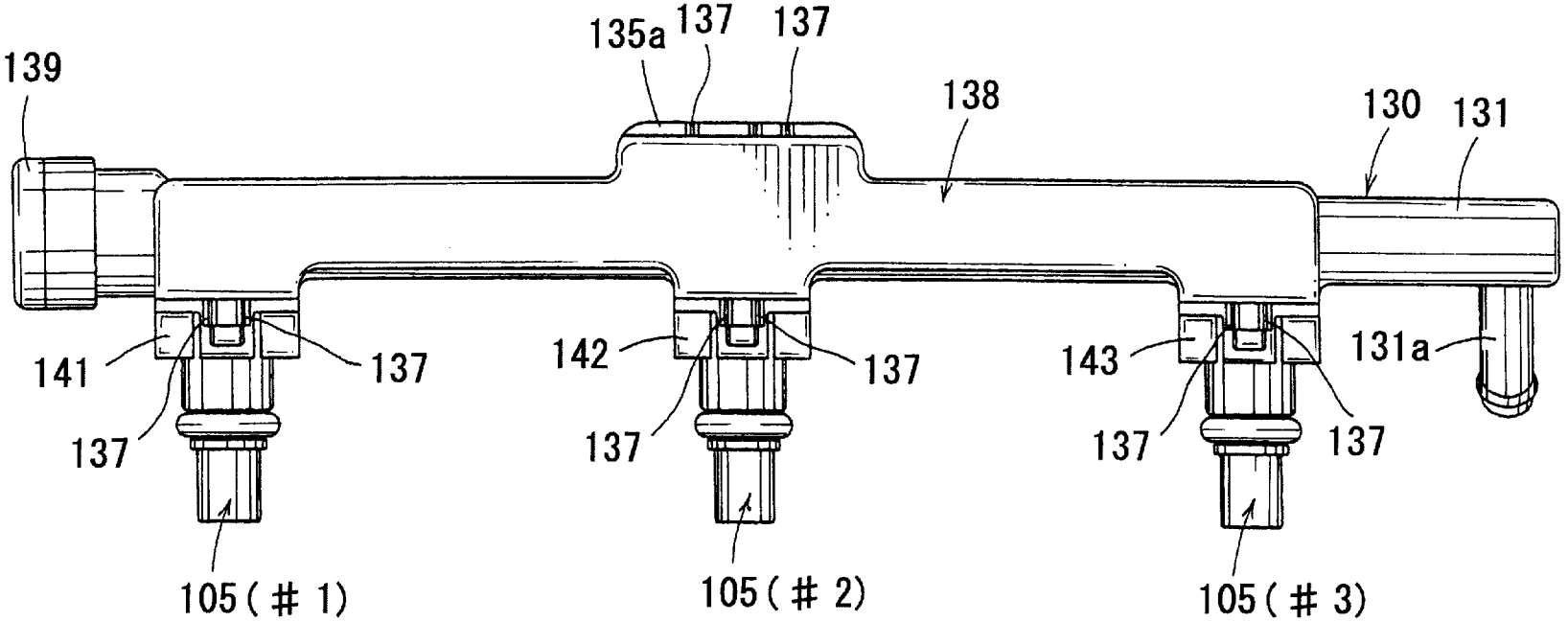
FIG. 16 is a front view of a second representative embodiment of an improved fuel delivery pipe.
Figure 17:
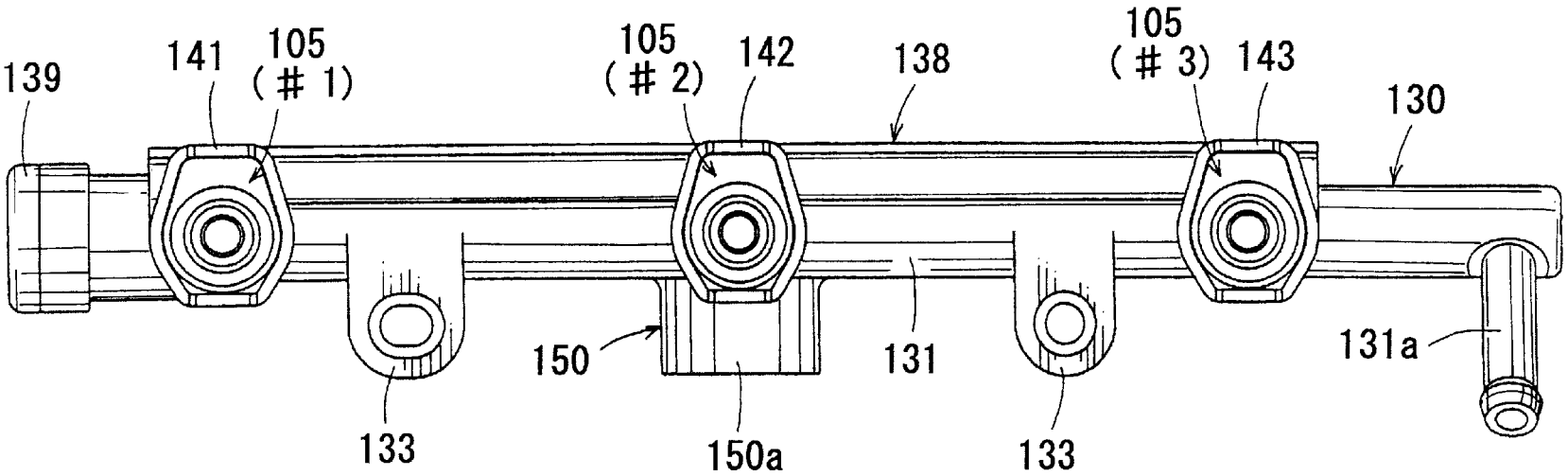
FIG. 17 is a bottom view of the second representative embodiment.

A fuel delivery pipe of a second representative embodiment also can be used, for example, in an in-line three-cylinder engine and has a connector block for injector. FIG. 16 is a front view of the fuel delivery pipe, and FIG. 17 is a bottom view of the fuel delivery pipe.

Figure 18:
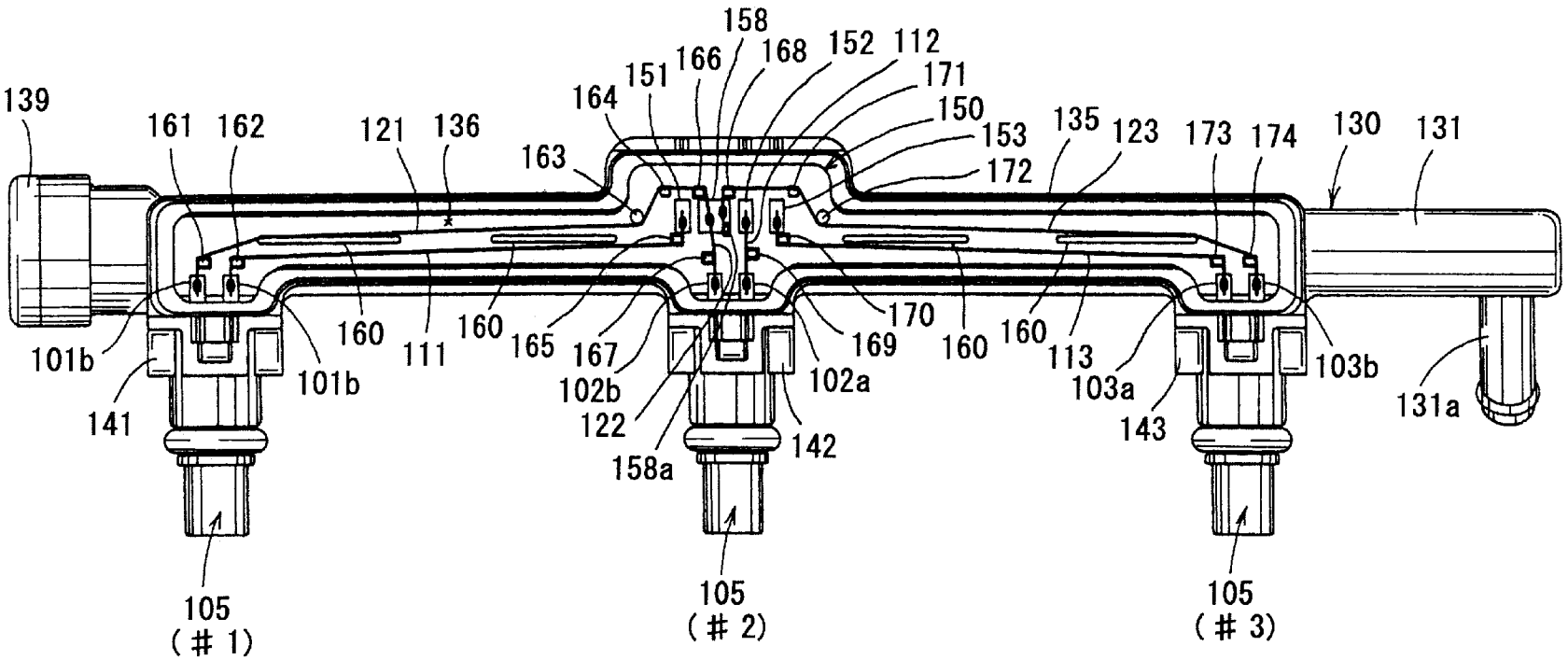
FIG. 18 is a view showing wiring in the second representative embodiment.
Figure 19:
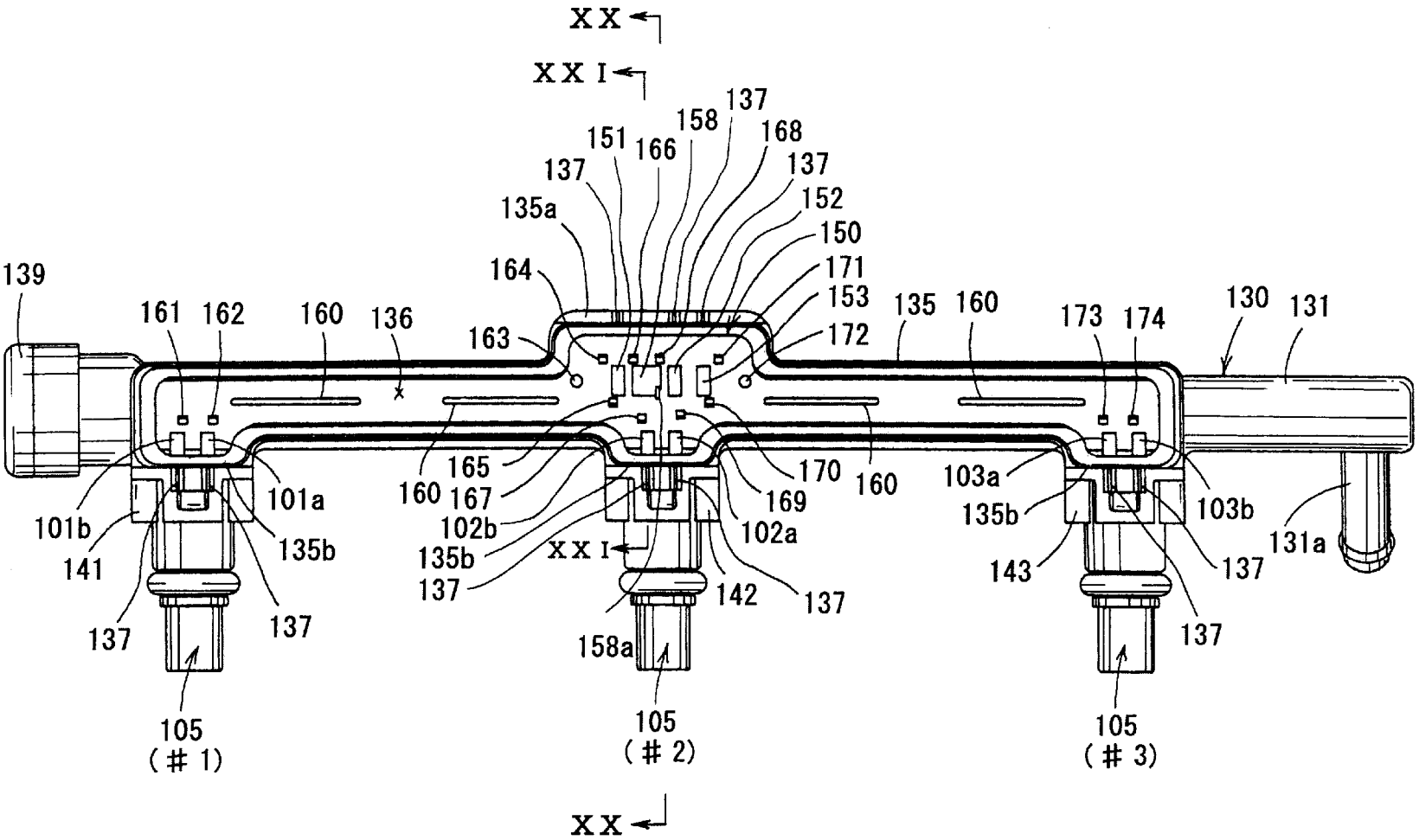
FIG. 19 is a front view of a connector block body.
Figure 20:
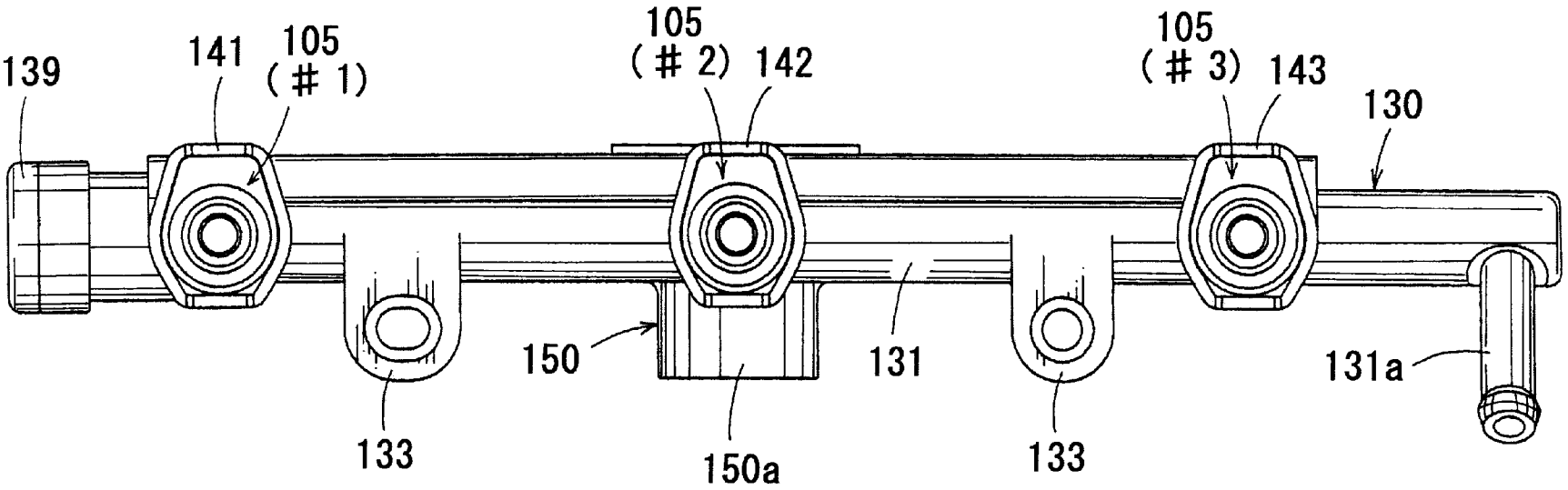
FIG. 20 is bottom view of the connector block body.
Figure 21:
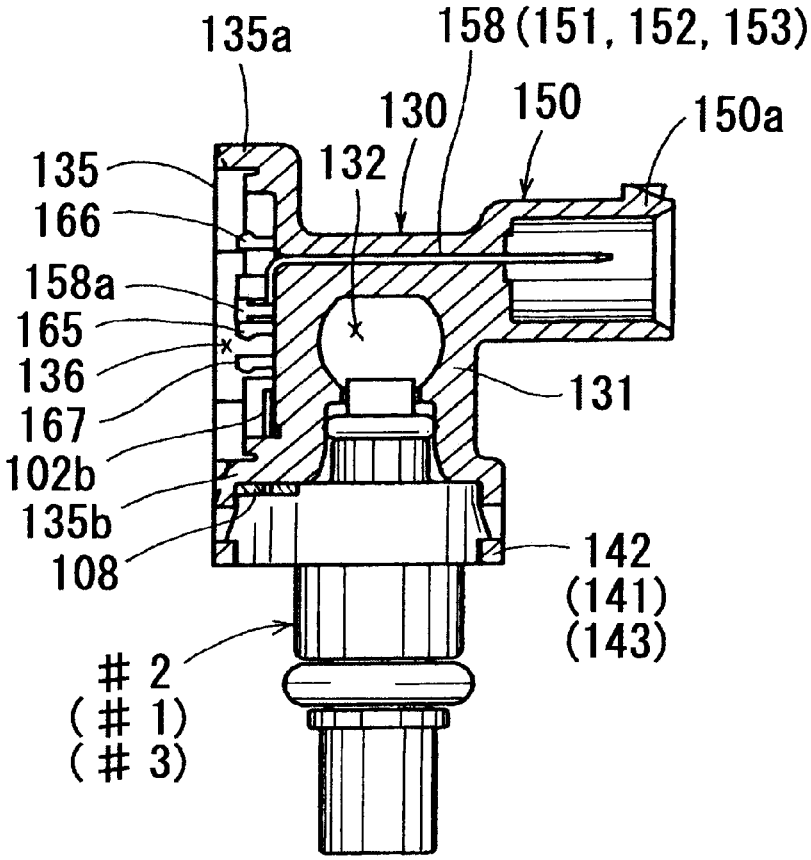
FIG. 21 is a sectional view taken along line XX—XX in FIG. 19.
Figure 22:
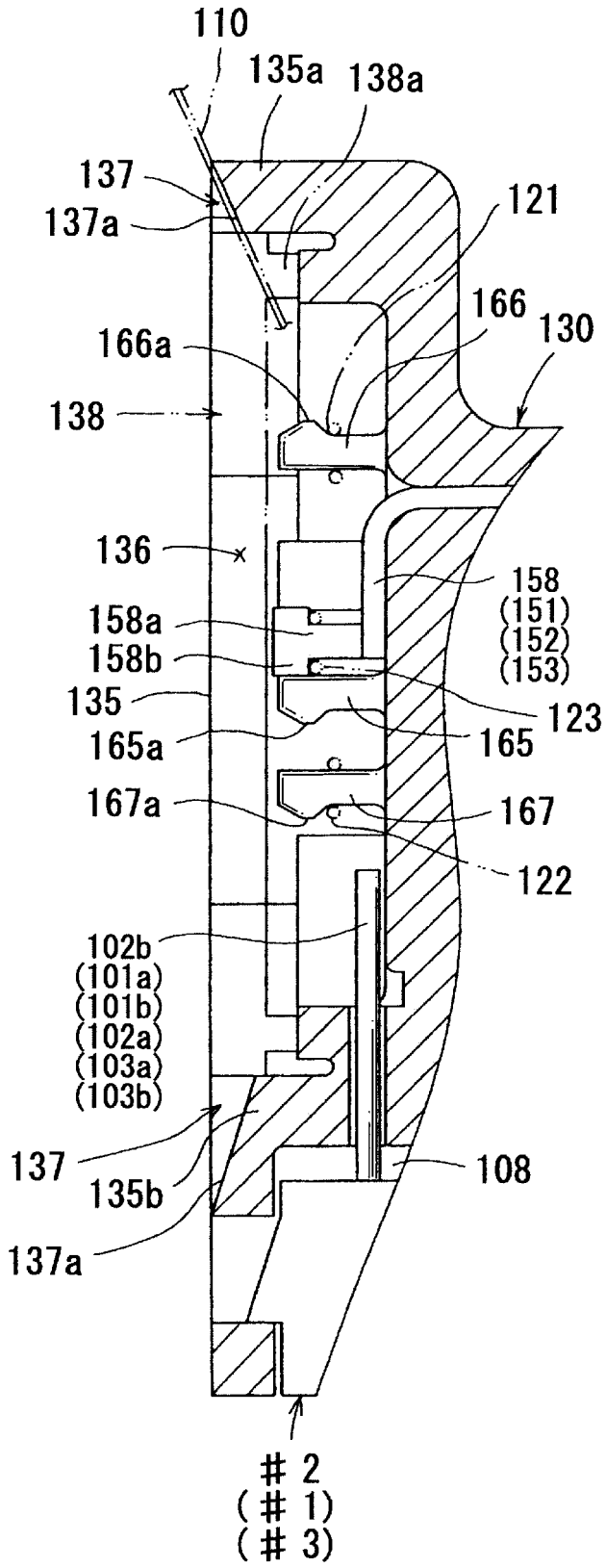
FIG. 22 is a sectional view taken along line XXI—XXI in FIG. 19.

The fuel delivery pipe of the second representative embodiment may include a connector block body 130 and a cover 138. The cover 138 is mounted on the front of the connector block body 130 (frontward as viewed in FIG. 16). FIG. 18 is a view showing the wiring in the connector block body 130; FIG. 19 is a front view of the connector block body 130; FIG. 20 is bottom view thereof; FIG. 21 is a sectional view taken along line XX—XX in FIG. 19; and FIG. 22 is a sectional view taken along line XXI—XXI in FIG. 19.

As shown in FIGS. 19 to 21, the connector block body 130 may mainly comprise a generally cylindrical pipe portion 131. A fuel supply passage 132 (see FIG. 21) is defined within the hollow space inside of the pipe portion 131. The connector block body 130 is preferably formed, for example, of a composite resin into which a filler-type short fiber reinforcing material has been mixed. A polyamide resin, such as 66 nylon, preferably may be used as the composite resin, and glass fiber preferably may be used as the filler-type reinforcing material.

A fuel supply pipe connecting portion 131*a* is integrally formed on one end (the right end as viewed in FIG. 19) of the pipe portion 131 and radially extends from the pipe portion 131 (downward as viewed in FIGS. 19 and 20). A fuel supply pipe (not shown) is connected to the fuel supply pipe connecting portion 131*a* and serves to supply fuel to the fuel supply passage 132 (see FIG. 21) of the pipe portion 131. The open end on the other end (the left end as viewed in FIG. 19) of the pipe portion 131 is sealed by a sealing cap 139. The sealing cap 139 is fixed to the pipe portion 131, for example, by heat deposition or by adhesives.

As shown in FIG. 20, right and left bosses 133 may be integrally formed on the back side (the lower side as viewed in FIG. 20) of the pipe portion 131. The bosses 133 preferably attach the fuel delivery pipe to the engine block (not shown) using bolts or other fasteners.

Three injector connecting portions 141, 142, 143 are integrally formed on the lower side of the pipe portion 131. Each of the injector connecting portions 141–143 has a generally cylindrical shape with an open lower end and communicates with the pipe portion 131.

Three injectors 105 (#1 to #3) are snap-fitted into the respective injector connecting portions 141 to 143. Fuel is supplied from the pipe portion 131 to the injectors 105.

As shown in FIG. 19, a pair of injector connecting terminals 101*a* and 101*b*, 102*a* and 102*b*, 103*a* and 103*b* is provided on each of the respective injectors 105 (#1 to #3). As shown in FIG. 22, the injector connecting terminals 102*b* (101*a*, . . . ) extend through a lower end portion 135*b* of a surrounding wall 135 formed on the connector block body 130. Thus, the injector connecting terminals 102*b* (101*a*, . . . ) are inserted into the inside of the wall 135. A packing or gasket 108 is disposed between the lower end portion 135*b* of the wall 135 and each of the injectors 105 and is fitted around the injector connecting terminal 102*b*.

One of the two injector connecting terminals for each injector 105 is used as an injector independent connecting terminal for supplying driving signals to the injector 105, while the other is used as an injector common connecting terminal. More specifically, injectors #1, #2 have injector independent connecting terminals 101*a*, 102*a* for supplying driving or induction signals to the injectors that are disposed on the right, and the injector common connecting terminals 101*b*, 102*b* that are disposed on the left. Injector #3 has the injector independent connecting terminal 103*a* for supplying driving or induction signals to the injectors that is disposed on the left, and the injector common connecting terminal 103*b* that is disposed on the right (see the wiring diagram of FIG. 25).

An external wiring connector 150 is integrally formed in the middle of the pipe portion 131. The connector 150 has a generally rectangular socket portion 150*a* with an open rear end (right end in FIG. 21). The connector 150 is positioned generally above the second injector connecting portion 142. A connector that is connected to external wiring is connected to the socket portion 150*a*.

As shown in FIG. 19, four external wiring connecting terminals 151, 152, 153, 158 are provided in the connector 150 and are preferably disposed in a row that is generally parallel to the row of the injectors.

As shown in FIG. 21, the external wiring connecting terminal 158 (151 to 153) extends transversely (from the left to the right as viewed in FIG. 21) through the connector 150. The rear end (the right end as viewed in FIG. 21) of the connecting terminal 158 (151 to 153) is disposed within the socket portion 150*a*. The front end (the left end as viewed in FIG. 21) of the connecting terminal 158 (151 to 153) is bent downward generally along the bottom surface of a wire distribution groove 136.

Of the four external wiring connecting terminals 151 to 153, 158, the second terminal 158 from the left in FIG. 19 is used as an external wiring common connecting terminal for grounding, and the remaining three connecting terminals 151 to 153 are used as external wiring independent connecting terminals for supplying driving or induction signals to the injectors. The external wiring common connecting terminal 158 is wider than the external wiring independent connecting terminals 151 to 153. Further, as shown in FIG. 22, a generally pin-shaped wiring guide 158*a* extends from the front end portion (the left end portion as viewed in FIG. 22) of the common connecting terminal 158. A wire retainer 158*b* is formed on and extends in generally vertical direction from the end of the wire guide 158*a* and basically has a T-shape.

As shown in FIG. 19, a surrounding wall 135 extends forward and forms a widthwise elongated rectangular frame. The surrounding wall 135 includes an upper wall portion 135*a* and lower wall portions 135*b*. The upper wall portion 135*a* protrudes upwardly and formed to correspond to the external wiring connector 150. The lower wall portions 135*b* protrude downwardly and are formed to correspond to the injector connecting portions 141 to 143. A recessed portion within the surrounding wall 135 comprises a wire distribution groove 136 in which wires are laid.

Wire receiving grooves 137 are formed (vertically as viewed in FIG. 19) across the upper wall portion 135*a* and the lower wall portions 135*b* of the surrounding wall 135. Three wire receiving grooves 137 are formed in the upper wall portion 135*a* and are positioned substantially directly above the first to third external wiring independent connecting terminals 151 to 153. Six wire receiving grooves 137 are formed in the lower wall portions 135*b* and are positioned substantially directly below the injector independent connecting terminals 101*a*, 102*a*, 103*a* and the injector common connecting terminals 101*b*, 102*b*, 103*b*.

As shown in FIG. 22, the wire receiving grooves 137 are open to the front end surface (the left end surface as viewed in FIG. 22) and can receive the wires across the wall portions 135*a*, 135*b* of the surrounding wall 135. Each bottom surface 137*a* of the wire receiving grooves 137 is inclined inwardly from the outside to the inside (the side of the wire distribution groove 136) of the wall portions 135*a*, 135*b* of the surrounding wall 135 such that the grooves 137 become deeper.

As shown in FIG. 19, a plurality of partitions 160 (four in this embodiment) are formed on the bottom surface of the wire distribution groove 136 and extend discontinuously along a longitudinally extending line. Two partitions 160 are disposed on each of the right and left sides of the external wiring connector 150 provided in the middle and thus substantially divide the inside of the wire distribution groove 136 into upper and lower halves.

Fourteen wiring guides 161 to 174 are provided on the bottom surface of the wire distribution groove 136 and are arranged irregularly from the left to the right in this order. In FIG. 19, the wire guides 161 and 162 are disposed generally above the injector connecting terminals 101*a*, 101*b* of the injector #1. The wire guide 163 is disposed at about a medial position between the external wiring independent connecting terminal 151 and the right end of the partition 160 that is disposed to the left of the terminal 151. The wire guide 164 is disposed on the upper left of the independent connecting terminal 151. The wire guide 165 is disposed generally below the independent connecting terminal 151. The wire guide 166 is disposed on the upper left of the common connecting terminal 158.

The wire guide 167 is disposed at about a medial position between the external wiring common connecting terminal 158 and the injector common connecting terminal 102*b* of the injector #2. The wire guide 168 is disposed on the upper right of the common connecting terminal 158. The wire guide 169 is disposed at about a medial position between the independent connecting terminal 152 and the injector independent connecting terminal 102*a* of the injector #2. The wire guide 170 is disposed generally below the independent connecting terminal 153. The wire guide 171 is disposed on the upper right of the independent connecting terminal 153. The wire guide 172 is disposed at about a medial position between the independent connecting terminal 153 and the left end of the partition 160 that is situated to the right of the terminal 153. The wire guides 173, 174 are disposed generally above the respective connecting terminals 103*a*, 103*b* of the injector #3. Each of the wire guides 161 to 174 is disposed in a position to change the routing direction of wires 11 to 13 (which will be described below)(see FIG. 18).

As shown in FIG. 19, the wire guides 163, 172 are generally cylindrical and the remaining wiring guides are generally rectangular. Further, as shown in FIG. 22, an upwardly protruding wire retainer 166*a* is formed in the end of the wire guide 166. Similar upwardly protruding wire retainers (not shown) are also formed in the end of the wire guides 161, 162, 164, 168, 171, 173, 174. Further, downwardly protruding wire retainers 165*a*, 167*a* are formed in the end of the wire guides 165, 167. Similar downwardly protruding wire retainers (not shown) are also formed in the end of the wire guides 161, 169, 170.

Figure 25:
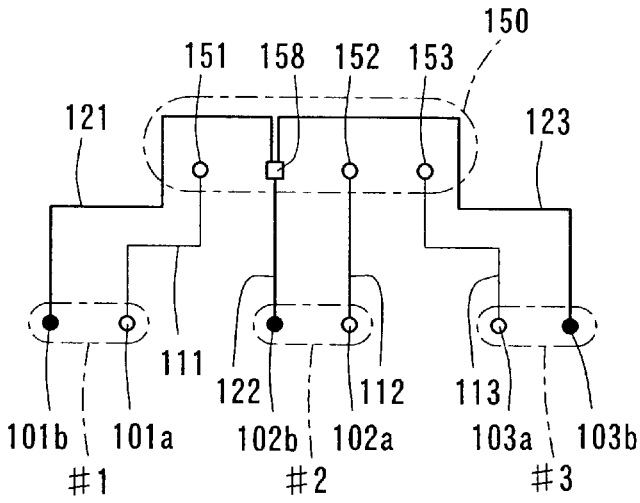
FIG. 25 is the wiring diagram of the second representative embodiment.

As shown in FIG. 25, the three independent wires 111 to 113 and the three common wires 121 to 123 are connected to the injector connecting terminals 101*a*, 101*b*, 102*a*, 102*b*, 103*a*, 103*b* on one end and the other ends are all routed to the connector 150. The wires 111 to 113, 121 to 123 are installed in generally the same plane so as not to cross each other, in a manner that will be described in further detail below. The wires 111 to 113, 121 to 123 are, for example, magnet wires. The ends of the wires are connected to the injector connecting terminals 101*a*, 101*b*, 102*a*, 102*b*, 103*a*, 103*b* of the injectors #1 to #3 and the connecting terminals 151 to 153,158 of the connector 150, for example, by soldering, ultrasonic deposition, resistance welding or similar fastening processes.

Specifically, as shown in FIG. 25, one end of the first independent wire 111 is connected to the injector independent connecting terminal 101*a* of the injector #1, while the other end is routed from the injector side of the external wiring connecting terminal row (from below as viewed in FIG. 25) and connected to the external wiring independent connecting terminal 151. One end of the second independent wire 112 is connected to the injector independent connecting terminal 102*a* of the injector #2, while the other end is routed from the injector side of the external wiring connecting terminal row (from below as viewed in FIG. 25) and connected to the independent connecting terminal 152. One end of the third independent wire 113 is connected to the injector independent connecting terminal 103*a* of the injector #3, while the other end is routed from the injector side of the external wiring connecting terminal row (from below as viewed in FIG. 25) and connected to the independent connecting terminal 153.

One end of the common wile 121 is connected to the injector common connecting terminal 101*b* of the injector #1, while the other end is routed from the side opposite to the injector side of the external wiring connecting terminal row (from above as viewed in FIG. 25) and connected to the common connecting terminal 158. Specifically, the first common wire 121 takes a detour from above the first connecting terminal 151 or from the side opposite to the injector side. One end of the second common wire 122 is connected to the injector common connecting terminal 102*b* of the injector #2, while the other end is routed from the injector side of the external wiring connecting terminal row (from below as viewed in FIG. 25) and connected to the common connecting terminal 158. In this embodiment, the common wires 121 and 122 are integrated into one wire across the common connecting terminal 158. One end of the third common wire 123 is connected to the injector common connecting terminal 103*b* of the injector #3, while the other end is routed from the side opposite to the injector side of the external wiring connecting terminal row (from above as viewed in FIG. 25) and connected to the common connecting terminal 158. Specifically, the common wire 123 takes a detour from above the connecting terminals 152, 153 or from the side opposite to the injector side.

Further, as shown in FIG. 18, the independent wire 111 is disposed within the lower half of the groove 136 that is partitioned by the partitions 160 in the left half of the groove 136 inside the surrounding wall 135. The independent wire 111 is routed through the wire guides 162, 165. The independent wire 112 is routed through the wire guide 169. The independent wire 113 is disposed within the lower half of the groove 136 that is partitioned by the partitions 160 in the right half of the groove 136 inside the surrounding wall 135. The independent wire 113 is routed through the wire guides 170, 173.

The common wire 121 is disposed within the upper half of the groove 136 that is partitioned by the partitions 160 in the left half of the groove 136 inside the surrounding wall 135. The common wire 121 is routed through the wire guides 161, 163, 164, 166. The common wire 122 is routed through the wire guide 167. The common wire 123 is disposed within the upper half of the groove 136 that is partitioned by the partitions 160 in the right half of the groove 136 inside the surrounding wall 135. The common wire 123 is routed through the wire guide 158*a* of the external wiring common connecting terminal 158 and through the wire guides 168, 171, 172, 174.

The wire guide 158*a* of the external wiring common connecting terminal 158 and the wire guides 161, 162, 165 to 170, 173, 174 in this embodiment correspond to "wiring guides around which wires are wound" in this specification. The wires are wound about one and a half turns around the wire guides. Further, the wire guides 163, 164, 171, 172 correspond to "wiring guides on which wires are hooked." The wires are hooked on these wiring guides. The wires may also be wound more than one turn around the wire guides 163, 164, 171, 172.

The wire retainers (158*b*, 165*a*, 166*a*, 167*a* (see FIG. 22)) of the wire guides 158*a*, 161, 162, 164 to 171, 173, 174 prevent the wires 111 to 113, 121 to 123 from being removed from the wire guides.

The independent wires 111 to 113 and the common wires 121 to 123 are installed using a method of installing the wires that will now be explained in further detail. The wire installing method includes the steps of routing the wires, connecting the wires and removing or cutting out unnecessary or surplus wires.

Figure 26:
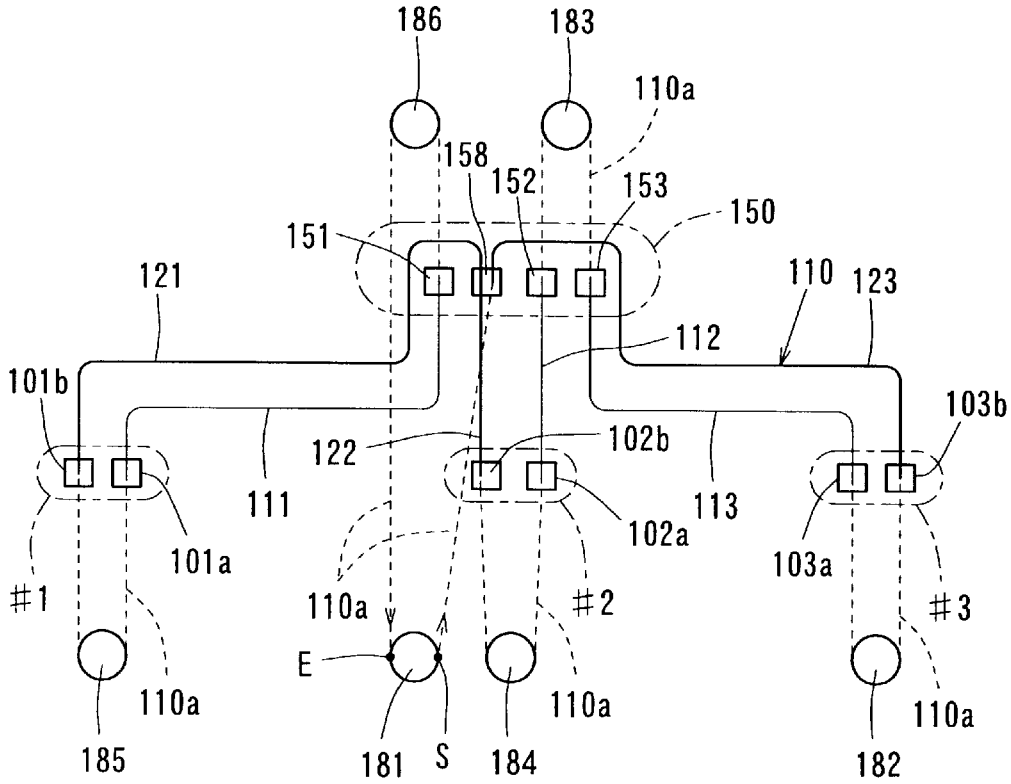
FIG. 26 is a wire routing diagram of the second representative embodiment.
Figure 27:
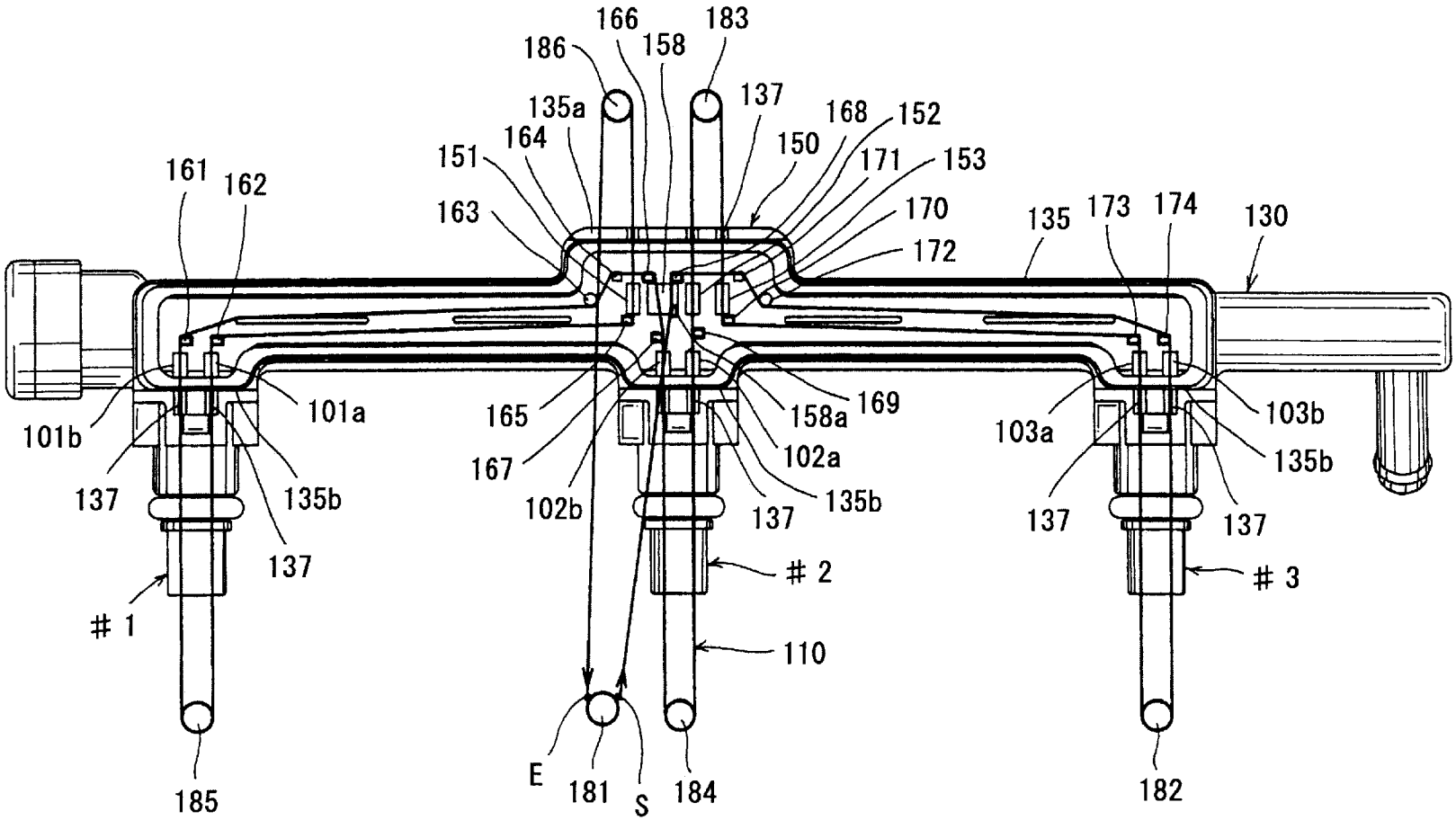
FIG. 27 is a view showing a wire routed along the wire routing path of the second representative embodiment.

In the routing step, as shown in FIG. 27, a wire 110 is routed along a wire routing path through each of the wire guides 158*a*, 161 to 174 of the connector block body 130, the independent connecting terminals 101*a*, 102*a*, 103*a* and the common connecting terminals 101*b*, 102*b*, 103*b* of the injectors #1 to #3, the independent connecting terminals 151 to 153 and the common connecting terminal 158 of the external wiring connector 150, and six auxiliary guides 181 to 186. The wire 110 preferably may be installed in a single continuous operation along the wire routing path. A known automatic wiring machine can be used to install the wire 110. An appropriate automatic wiring machine is sold by Fanuc as model LRMET, although other automatic wire machines may be utilized with the present teachings. In the wire routing diagram of FIG. 26, portions of the wire 110 that form the independent wires 111 to 113 are shown by fine lines and portions of the wire 110 that form the common wires 121 to 123 are shown by heavy lines. The wire portions shown by fine lines and heavy lines are necessary wire portions. The remaining wire portions shown by dotted lines are unnecessary or surplus wire portions 110*a*. Both independent wires 111–113 and common wires 121–123 may be the same type of wire or may be different types of wires.

As shown in FIG. 27, six generally rod-like auxiliary guides 181 to 186 are positioned around the connector block body 130. The six auxiliary guides 181 to 186 are vertically disposed on a work support base of an automatic wiring machine (not shown). A preferred arrangement for the auxiliary guides is as follows. The auxiliary guide 181 is disposed below the independent connecting terminal 151. The auxiliary guide 182 is disposed below the injector #3. The auxiliary guide 183 is disposed above the external wiring independent connecting terminals 152, 153. The auxiliary guide 184 is disposed below the injector #2. The auxiliary guide 185 is disposed below the injector #1. The auxiliary guide 186 is disposed above the independent connecting terminal 151.

As shown in FIGS. 26 and 27, the wire 110 is installed by the automatic wiring machine routing the wire from a starting point S of the auxiliary guide 181 back to an ending point E of the auxiliary guide 181. The wire 110 preferably passes through the external wiring common connecting terminal 158, the common connecting terminal 103*b* of the injector #3, the auxiliary guide 182, the independent connecting terminal 103*a* of the injector #3, the independent connecting terminal 153, the auxiliary guide 183, the independent connecting terminal 152, the independent connecting terminal 102*a* of the injector #2, the auxiliary guide 184, the common connecting terminal 102*b* of the injector #2, the common connecting terminal 158, the common connecting terminal 101*b* of the injector #1, the auxiliary guide 185, the independent connecting terminal 101*a* of the injector #1, the independent connecting terminal 151 and the auxiliary guide 186 in this order.

During the wire installation process, the wire 110 is routed using a predetermined tension while being wound around the wire guides 158*a*, 161, 162, 165 to 170, 173, 174 and hooked on the wire guides 163, 164, 171, 172. While leading the wire 110 out of and into the wire distribution groove 136, the wire 110 is received in the wire receiving grooves 137 across the wall portions 135*a*, 135*b* of the surrounding wall 135 of the connector block body 130. As shown in FIG. 27, portions of the wire 110 extend between the auxiliary guides 181 to 186 and the wire guides 161, 162, 165, 167, 169, 170, 173, 174 and are routed across the independent connecting terminals 101*a*, 102*a*, 103*a* and the common connecting terminals 101*b*, 102*b*, 103*b* of the injectors #1 to #3 and the independent connecting terminals 151 to 153 and the common connecting terminal 158 of the external wiring connector 150.

Subsequently, in the wire connecting step, the wire 110 is connected to the connecting terminals 101*a*, 102*a*, 103*a*, 101*b*, 102*b*, 103*b*, 151, 152, 153, 158, for example, by soldering, ultrasonic deposition, resistance welding or similar fastening processes.

Subsequently, in the wire removal step, unnecessary or surplus wire portions 110*a* (see FIG. 26) are removed or cut out by a cutting device in the automatic wiring machine (not shown), which unnecessary wire portions 110*a* are portions of the wire 110 other than the necessary wire portions (the independent wires 111 to 113 and the common wires 121 to 123) that are connected between the independent connecting terminals 101*a*, 102*a*, 103*a* and the common connecting terminals 101*b*, 102*b*, 103*b* of the injectors #1 to #3 and the independent connecting terminals 151 to 153 and the common connecting terminal 158 of the external wiring connector 150. Thus, as shown in FIG. 18, the installation of the wires 111 to 113, 121 to 123 with respect to the connector block body 130 is completed.

Figure 23:
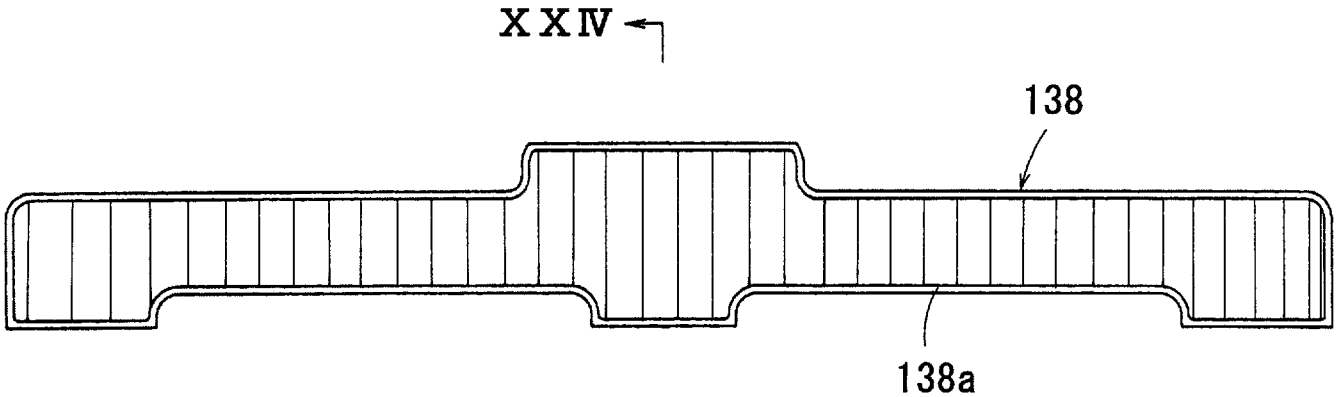
FIG. 23 is a front view of a cover.
Figure 24:
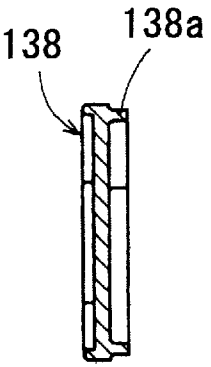
FIG. 24 is a sectional view taken along line XXIV—XXIV in FIG. 23.

As shown in FIGS. 16 and 17, the cover 138 covers the wire distribution groove 136 in which the wires 111 to 113, 121 to 123 have been installed. FIG. 23 is a front view of the cover 138 and FIG. 24 is a sectional view taken along line XXIV—XXIV in FIG. 23.

The cover 138 may comprise an identical of similar material as the connector block body 130 and preferably has a plate-like shape. The contour of the cover 138 is formed to generally corresponding to the surrounding wall 135 of the connector block body 130. Further, a rib 138*a* is integrally formed to correspond to the surrounding wall 135 on the outer peripheral edge of the back of the cover 138. The rib 138*a* of the cover 138 is fitted on the surrounding wall 135 and joined to the connector block body 130, for example, by vibration deposition or by adhesives. The assembly of the fuel delivery pipe is completed when the cover 138 is placed on the wire distribution groove 136.

As described above, the fuel delivery pipe of this representative embodiment has wires 111 to 113, 121 to 123 that are wound around the wire guides 158*a*, 161, 162, 165 to 170, 173, 174 while being connected between the independent connecting terminals 101*a*, 102*a*, 103*a* and the common connecting terminals 101*b*, 102*b*, 103*b* of the injectors #1 to #3 and the independent connecting terminals 151 to 153 and the common connecting terminal 158 of the external wiring connector 150. Therefore, the wires 111 to 113, 121 to 123 can be securely installed.

Also, the wire guides 163, 164,171, 172 on which the wires 111 to 113 are hooked are also provided in the connector block body 130 and thus, can be used in combination with the wire guides 158*a*, 161, 162, 165 to 170, 173, 174 around which the wires 121 to 123 are wound.

Each of the wire guides 161 to 174 is disposed in a position to change the wiring direction of the wires 111 to 113, thereby permitting a change in the wiring direction of the wires 111 to 113.

Further, by providing the wire retainers (158*b*, 165*a*, 166*a*, 167*a*) in the wire guides 158*a*, 161, 162, 164 to 171, 173, 174, the wires 111 to 113 and 121 to 123, which are wound around or hooked on the wire guides, can be prevented from being removed from the wire guides.

By routing the wire 121 (including the wire 122) across the common connecting terminal 158 of the external wiring connector 150, the wire 121 can be readily connected to the common connecting terminal 158.

Further, because the wire receiving grooves 137 receive the wire 110 across the wall portions 135*a*, 135*b* of the surrounding wall 135, the wire 110 can be led through the grooves 137 near to the bottom surface of the wire distribution groove 136 of the connector block body 130.

By routing the wire 110 in one continuous operation along the wire routing path in the wire routing step, the routing operation can be facilitated and routing the wire 110 in one continuous operation along the wire routing path in the wire routing step can reduce the time required for the wire installation operation.

The steps of routing the wires, connecting the wires and removing or cutting out unnecessary or surplus wires can be performed for an entire connector block in a single operation, which permits easy control of the automatic wiring machine.

By using the auxiliary guides 181 to 186 that are provided on the work support base (not shown) of the automatic wiring machine for wiring the wire 110, the wire 110 can be easily routed.

If the auxiliary guides 181 to 186 are not used, wiring guides should be provided in the connector block body 130 as a substitute for the auxiliary guides 181 to 186. In such a case, the connector block body 130 may become larger in size. In this embodiment, however, such wire guides are not necessary, so that the connector block body 130 can be smaller.

Further, in the wire routing step, portions of the wire 110 which extend between the auxiliary guides 181 to 186 and the wire guides 161, 162, 165, 167, 169, 170, 173, 174, are routed across the independent connecting terminals 101*a*, 102*a*, 103*a* and the common connecting terminals 101*b*, 102*b*, 103*b* of the injectors #1 to #3 and the independent connecting terminals 151 to 153 and the common connecting terminal 158 of the external wiring connector 150. Therefore, such portions of the wire 110 that extend between the auxiliary guides 181 to 186 and the wire guides 161, 162, 165, 167, 169, 170, 173, 174 can be readily connected to the connecting terminals 101*a*, 102*a*, 103*a*, 101*b*, 102*b*, 103*b*, 151 to 153, 158.

By providing an injector connector block in a fuel supply system that includes injectors, a fuel pump and a fuel delivery pipe, the wires 111 to 113, 121 to 123 can be securely connected and the occurrence of short-circuits in the connector block body 130 can be reduced or prevented.

By forming the fuel supply passage 132 integrally in the connector block body 130, a fuel delivery pipe can be provided in which the wires 111 to 113, 121 to 123 can be securely connected and the occurrence of short-circuits in the connector block body 130 can be reduced or prevented.

Further, in the fuel delivery pipe of this representative embodiment, the independent wires 111 to 113 are connected to the independent connecting terminals 101*a*, 102*a*, 103*a* of the injectors #1 to #3 on one end, while the other ends are connected from the injector side to the independent connecting terminals 151 to 153 of the external wiring connector 150. The common wires 121 to 123 are connected to the common connecting terminals 101*b*, 102*b*, 103*b* of the injectors #1 to #3 on one end. The other end of the common wire 122 is connected from the injector side to the common connecting terminal 158 of the external wiring connector 150, while the other ends of the common wires 121, 123 are routed from the side opposite to the injector side and connected to the common connecting terminal 158. Thus, the independent wires 111 to 113 and the common wires 121 to 123 can be installed without crossing each other, thereby preventing the wires in the connector block from short-circuiting.

The wires 111 to 113, 121 to 123 are installed in generally the sane plane, thereby preventing the thickness of the connector block from increasing as compared to a wire installation process in which the wires cross each other.

Further, the wires 111 to 113, 121 to 123 are separated from each other by the partitions 160 in the wire distribution groove 136, so that the wires 111 to 113, 121 to 123 can be reliably insulated from each other.

In addition, the wires 111 to 113, 121 to 123 are directly connected to the connecting terminals 101*a*, 101*b*, 102*a*, 102*b*, 103*a*, 103*b* of the injectors #1 to #3. Therefore, it is not necessary to provide relay terminals for connecting the injector side ends of the wires 111 to 113, 121 to 123 to the connecting terminals 101*a*, 101*b*, 102*a*, 102*b*, 103*a*, 103*b* of the injectors #1 to #3. However, the present teachings may also be applied to a fuel delivery pipe having a relay terminal.

Moreover, the wires 111 to 113, 121 to 123 are installed within the wire distribution groove 136 of the connector block body 130, which groove is covered by the cover 138.

Therefore, unlike known fuel delivery pipes, in which the wires 111 to 113, 121 to 123 are formed in the connector block body 130 by injection molding, warping of the connector block body 130 or distortion of the wires 111 to 113, 121 to 123 can be prevented. Warping may be caused by differential thermal expansion between the connector block body 130 and the wires 111 to 113, 121 to 123.

Third Representative Embodiment

Figure 28:
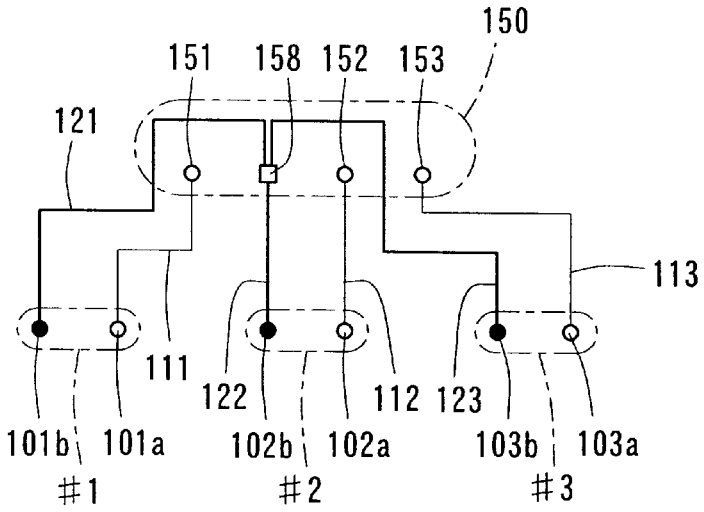
FIG. 28 is the wiring diagram of a third representative embodiment.

A third representative embodiment will now be explained in further detail with reference to the wiring diagram of FIG. 28. The third representative embodiment is a modification of the second representative embodiment, and only changed or modified portions will be discussed. Parts identical or substantially identical to those in the second embodiment are given like numerals as in the second embodiment. Also, with respect to the following representative embodiment, overlapping description will be omitted. In FIG. 28, wires on the side of the independent connecting terminals are shown by fine lines, while wires on the side of the common connecting terminals are shown by heavy lines.

In the third representative embodiment, the locations of the independent connecting terminal 103*a* and the common connecting terminal 103*b* of the injector #3 in the second embodiment are swapped. Also in this case, one end of the independent wire 113 is connected to the independent connecting terminal 103*a* of the injector #3, while the other end is connected from the injector side of the external wiring connecting terminal row (from below as viewed in FIG. 28) to the independent connecting terminal 153. One end of the common wire 123 is connected to the injector common connecting terminal 103*b* of the injector #3, while the other end is connected from the side opposite to the injector side of the external wiring connecting terminal row (from above as viewed in FIG. 28) to the common connecting terminal 158. Specifically, the common wire 123 takes a detour from above the connecting terminal 152 or from the side opposite to the injector side of the connecting terminal 152.

Also, in this third representative embodiment, the wires 111 to 113, 121 to 123 can be installed without crossing each other between the independent connecting terminals 101*a*, 102*a*, 103*a* and the common connecting terminals 101*b*, 102*b*, 103*b* of the injectors #1 to #3, and the independent connecting terminals 151 to 153 and the common connecting terminal 158 of the external wiring connector 150.

Fourth Representative Embodiment

Figure 29:
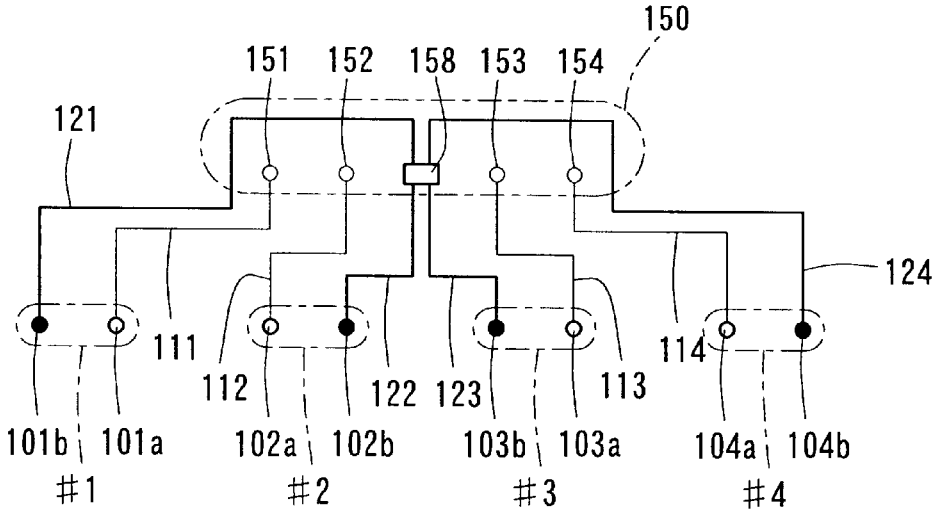
FIG. 29 is the wiring diagram of a fourth representative embodiment.
Figure 30:
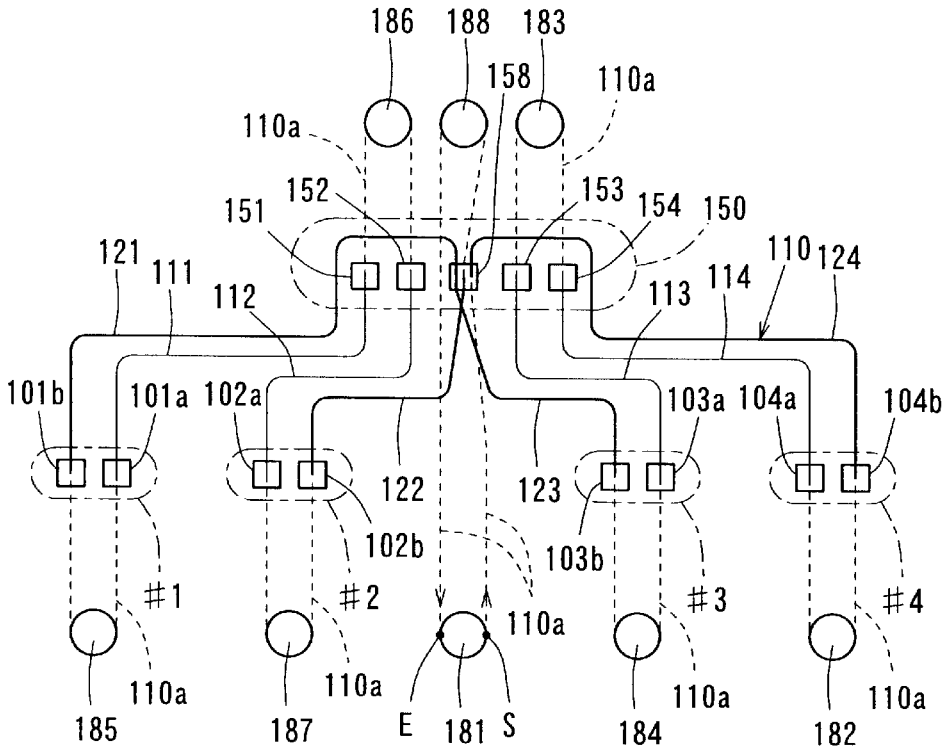
FIG. 30 is a wire routing diagram of the fourth representative embodiment.

A fourth representative embodiment will now be explained in further detail with reference to the wiring diagram of FIG. 29 and the wire routing diagram of FIG. 30. In FIGS. 29 and 30, wires on the side of the independent connecting terminals are shown by fine lines, while wires on the side of the common connecting terminals are shown by heavy lines. In FIG. 30 (and FIG. 32), unnecessary or surplus wire portions 110*a* are shown by dotted lines, and auxiliary guides are shown by circles.

The fourth representative embodiment is a fuel delivery pipe for an in-line four cylinder engine and has four injectors #1 to #4 arranged from the left to the right in this order. In the injectors #1, #3, independent connecting terminals 101*a*, 103*a* are disposed on the right, while common connecting terminals 101*b*, 103*b* are disposed on the left. In the injectors #2, #4, independent connecting terminals 102*a*, 104*a* are disposed on the left, while common connecting terminals 102*b*, 104*b* are disposed on the right.

In the external wiring connector 150, five external wiring connecting terminals 151 to 154, 158 are disposed along the external wiring connecting terminal row that is generally parallel to the injector row. With the exception of the centrally located terminal 158, the connecting terminals 151 to 154 are used as external wining independent connecting terminals for supplying driving signals to the injectors #1 to #4. The centrally located connecting terminal 158 is used as an external wiring common connecting terminal.

The independent wires 111 to 114 are connected to the independent connecting terminals 101*a*, 102*a*, 103*a*, 104*a* of the injectors #1 to #4 on one end, while the other ends are connected from the injector side of the external wiring connecting terminal row (from below as viewed in FIG. 29) to the external wiring independent connecting terminals 151 to 154.

The common wire 121 is connected to the common connecting terminal 110*b* of the injector #1 on one end, while the other end is connected from the side opposite to the injector side of the external wiring connecting terminal row (from above as viewed in FIG. 29) to the external wiring common connecting terminal 158. Specifically, the common wire 121 takes a detour from above the connecting terminals 151, 152 or from the side opposite to the injector side. The common wires 122, 123 are connected to the common connecting terminals 102*b*, 103*b* of the injectors #2 and #3 on one end, while the other ends are connected from the injector side of the external wiring connecting terminal row (from below as viewed in FIG. 29) to the common connecting terminal 158. The common wire 124 is connected to the common connecting terminal 104*b* of the injector #4 on one end, while the other end is connected from the side opposite to the injector side of the external wiring connecting terminal row to the common connecting terminal 158. Specifically, the common wire 124 takes a detour from above the connecting terminals 153, 154 or from the side opposite to the injector side.

Also in the fourth embodiment, the wires 111 to 114, 121 to 124 can be installed without crossing each other between the independent connecting terminals 101*a*, 102*a*, 103*a*, 104*a* and the common connecting terminals 101*b*, 102*b*, 103*b*, 104*b* of the injectors #1 to #4, and the independent connecting terminals 151 to 154 and the common connecting terminal 158 of the external wiring connector 150.

The independent wires 111 to 114 and the common wires 121 to 124 are installed using a method of installing the wires that will be explained in further detail below. Similar to the second embodiment, this wiring method includes the steps of routing the wires, connecting the wires and removing or cutting out unnecessary or surplus wires.

In the routing step, as shown in FIG. 30, a single wire 110 is routed along a wire routing path through each of wiring guides (not shown) of the connector block body, the independent connecting terminals 101*a*, 102*a*, 103*a*, 104*a* and the common connecting terminals 101*b*, 102*b*, 103*b*, 104*b* of the injectors #1 to #4, the independent connecting terminals 151 to 154 and the common connecting terminal 158 of the external wiring connector 150, and eight auxiliary guides 181 to 188. The wire 110 preferably may be installed in a single continuous operation along the wire routing path. Similar to the second embodiment, a known automatic wiring machine can be used for this wire routing operation. In FIG. 30, portions of the wire 110 that form the independent wires 111 to 114 are shown by fine lines and portions of the wire 110 that form the common wires 121 to 124 are shown by heavy lines. The wire portions shown by fine lines and heavy lines are necessary wire portions. The remaining wire portions shown by dotted lines are unnecessary or surplus wire portions 110*a*.

As shown in FIG. 30, generally rod-like auxiliary guides 181 to 188 are positioned around the connector block body 130. Similar to the second embodiment, the auxiliary guides 181 to 188 are vertically disposed on a work support base of the automatic wiring machine (not shown). The auxiliary guide 181 is disposed below the common connecting terminal 158. The auxiliary guide 182 is disposed below the injector #4. The third auxiliary guide 183 is disposed above the independent connecting terminals 153, 154. The auxiliary guide 184 is disposed below the injector #3. The auxiliary guide 185 is disposed below the injector #1. The auxiliary guide 186 is disposed above the independent connecting terminals 151, 152. The auxiliary guide 187 is disposed below the injector #2. The auxiliary guide 188 is disposed above the common connecting terminal 158.

As shown in FIG. 30, the automatic wiring machine routes the wire 110 from a starting point S of the auxiliary guide 181 back to an ending point E of the auxiliary guide 181. The wire 110 may pass through the external wiring common connecting terminal 158, the common connecting terminal 104*b* of the injector #4, the auxiliary guide 182, the independent connecting terminal 104*a* of the injector #4, the independent connecting terminal 154, the auxiliary guide 183, the independent connecting terminal 153, the independent connecting terminal 103*a* of the injector #3, the auxiliary guide 184, the common connecting terminal 103*b* of the injector #3, the common connecting terminal 158, the common connecting terminal 101*b* of the injector #1, the auxiliary guide 185, the independent connecting terminal 101*a* of the injector #1, the independent connecting terminal 151, the auxiliary guide 186, the independent connecting terminal 152, the independent connecting terminal 102*a* of the injector #2, the auxiliary guide 187, the common connecting terminal 102*b* of the injector #2, the common connecting terminal 158 and the auxiliary guide 188 in this order. Similar to the second embodiment, the wire 10 is installed using a predetermined tension while being wound around or hooked on the wire guides (not shown).

Subsequently, in the wire connecting step, the wire 110 is connected to the connecting terminals 101*a*, 102*a*, 103*a*, 104*a*, 101*b*, 102*b*, 103*b*, 104*b*, 151 to 154, 158, for example, by soldering, ultrasonic deposition, resistance welding or similar fastening processes.

Subsequently, in the wire removal step, the unnecessary or surplus wire portions 110*a* (see FIG. 30) are removed or cut out by a cutting device in the automatic wiring machine (not shown), which unnecessary or surplus wire portions 110*a* are portions of the wire 110 other than the necessary wire portions (the independent wires 111 to 114 and the common wires 121 to 124) that are connected between the independent connecting terminals 101*a*, 102*a*, 103*a*, 104*a* and the common connecting terminals 101*b*, 102*b*, 103*b*, 104*b* of the injectors #1 to #4 and the independent connecting terminals 151 to 154 and the common connecting terminal 158 of the external wiring connector 150. Thus, the wire installation of the wires 111 to 114, 121 to 124 with respect to the connector block body 130 is completed.

Fifth Representative Embodiment

Figure 31:
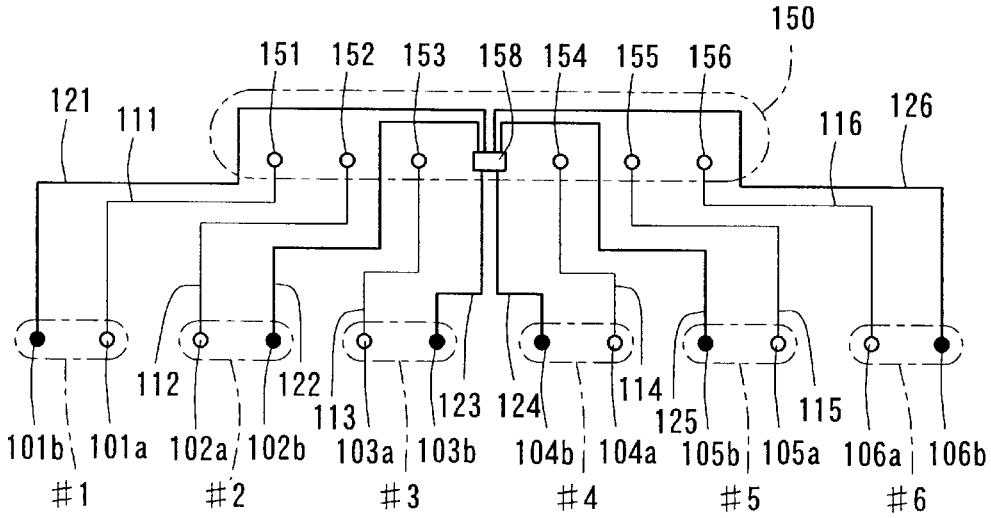
FIG. 31 is the wiring diagram of a fifth representative embodiment.

A fifth representative embodiment will now be explained in further detail with reference to the wiring diagram of FIG. 31 and the wire routing diagram of FIG. 32. The fifth representative embodiment is a fuel delivery pipe for an in-line six-cylinder engine and has six injectors #1 to #6 arranged from the left to the right in this order. In the injectors #1, #4, #5, the independent connecting terminals 101*a*, 104*a*, 105*a* are disposed on the right, while the common connecting terminals 101*b*, 104*b*, 105*b* are disposed on the left. In the injectors #2, #3, #6, the independent connecting terminals 102*a*, 103*a*, 106*a* are disposed on the left, while the common connecting terminals 102*b*, 103*b*, 106*b* are disposed on the right.

In the external wiring connector 150, seven external wiring connecting terminals 151 to 156, 158 are disposed along the external wiring connecting terminal row that is generally parallel to the injector row. With the exception of the centrally located terminal 158, connecting terminals 151 to 156 are used as external wiring independent connecting terminals for supplying driving signals to the injectors #1 to #6. The centrally located connecting terminal 158 is used as an external wiring common connecting terminal.

The independent wires 111 to 116 are connected to the independent connecting terminals 101*a*, 102*a*, 103*a*, 104*a*, 105*a*, 106*a* of the injectors #1 to #6 on one end, while the other ends are connected from the injector side of the external wiring connecting terminal row (from below as viewed in FIG. 31) to the external wiring independent connecting terminals 151 to 156.

The common wire 121 is connected to the common connecting terminal 101*b* of the injector #1 on one end, while the other end is connected from the side opposite to the injector side of the external wiring connecting terminal row (from above as viewed in FIG. 32) to the external wiring common connecting terminal 158. Specifically, the common wire 121 takes a detour from above the independent connecting terminals 151 to 153 or from the side opposite to the injector side.

The common wire 122 is connected to the common connecting terminal 102*b* of the injector #2 on one end, while the other end is connected from the side opposite to the injector side of the external wiring connecting terminal row (from above as viewed in FIG. 32) to the external wiring common connecting terminal 158. Specifically, the common wire 122 takes a detour from above the connecting terminal 153 or from the side opposite to the injector side.

The common wires 123, 124 are connected to the common connecting terminal 103*b*, 104*b* of the injectors #3, #4 on one end, while the other ends are connected from the injector side of the external wiring connecting terminal row (from below as viewed in FIG. 32) to the common connecting terminal 158. The common wires 123 and 124 may he integrated into one wire with respect to the common connecting terminal 158 and connected to the terminal 158.

The common wire 125 is connected to the common connecting terminal 105*b* of the injector #5 on one end, while the other end is connected from the side opposite to the injector side of the external wiring connecting terminal row (from above as viewed in FIG. 32) to the external wiring common connecting terminal 158. Specifically, the common wire 125 takes a detour from above the connecting terminal 154 or from the side opposite to the injector side.

The common wire 126 is connected to the common connecting terminal 106*b* of the injector #6 on one end, while the other end is connected from the side opposite to the injector side of the external wiring connecting terminal row (from above as viewed in FIG. 32) to the external wiring common connecting terminal 158. Specifically, the common wire 126 takes a detour from above the connecting terminals 154 to 156 or from the side opposite to the injector side. The common wires 125 and 126 may be integrated into one wire with respect to the common connecting terminal 158 and connected to the terminal 158.

Also, in the fifth embodiment, the wires 111 to 116, 121 to 126 can be installed without crossing each other between the independent connecting terminals 101*a*, 102*a*, 103*a*, 104*a*, 105*a*, 106*a* and the common connecting terminals 101*b*, 102*b*, 103*b*, 104*b*, 105*b*, 106*b* of the injectors #1 to #6, and the independent connecting terminals 151 to 156 and the common connecting terminal 158 of the external wiring connector 150.

The independent wires 111 to 116 and the common wires 121 to 126 are installed using a method of installing the wires that will be explained in further detail below. Similar to the second and fourth embodiments, this wiring method includes the steps of routing the wires, connecting the wires and removing or cutting out unnecessary or surplus wires.

Figure 32:
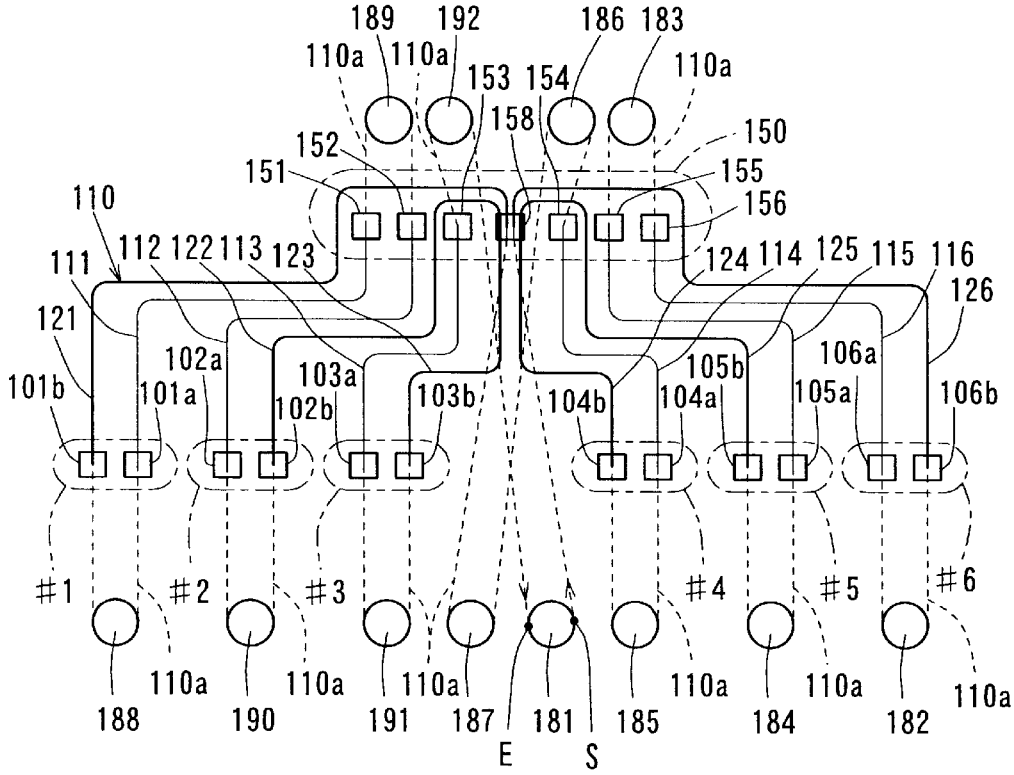
FIG. 32 is a wire routing diagram of the fifth representative embodiment.
Figure 33:
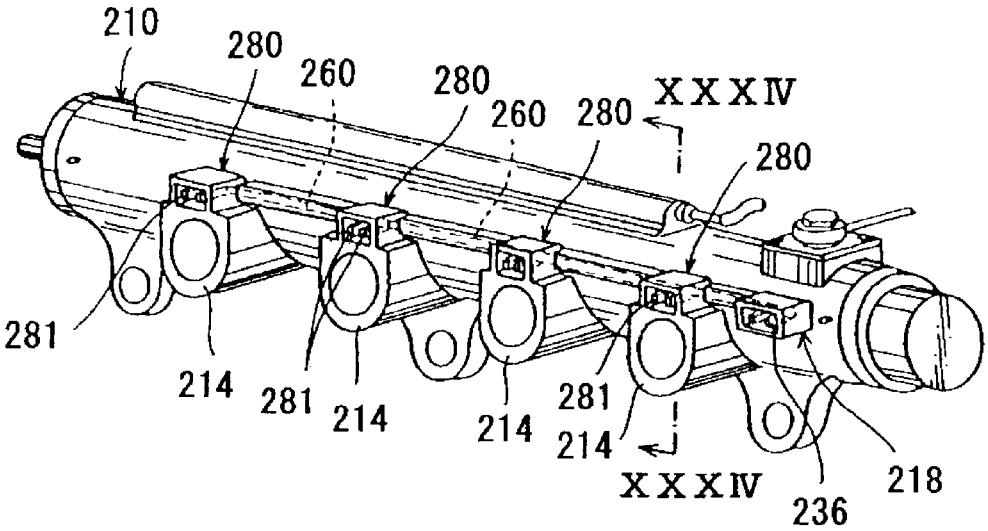
FIG. 33 PRIOR ART
FIG. 33 is a perspective view of a known fuel delivery pipe.
Figure 34:
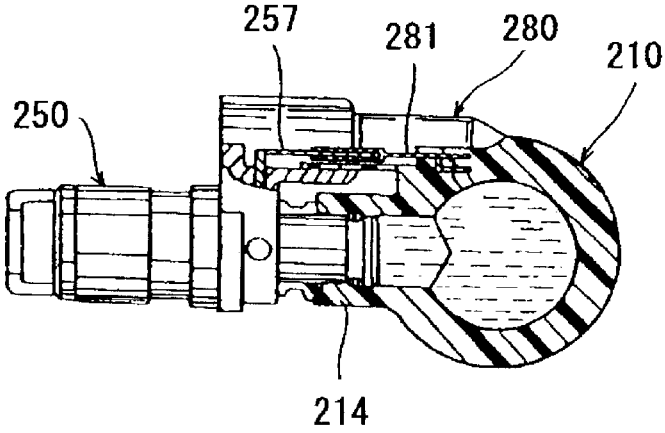
FIG. 34 PRIOR ART
FIG. 34 is a sectional view taken along line XXXIV—XXXIV in FIG. 33.

In the routing step, as shown in FIG. 32, a wire 110 is routed along a wire routing path through each of wiring guides (not shown) of the connector block body, the independent connecting terminals 101*a*, 102*a*, 103*a*, 104*a*, 105*a*, 106*a* and the common connecting terminals 101*b*, 102*b*, 103*b*, 104*b*, 105*b*, 106*b* of the injectors #1 to #6, the independent connecting terminals 151 to 156 and the common connecting terminal 158 of the external wiring connector 150, and twelve auxiliary guides 181 to 192. The wire 110 can be installed in a single continuous operation along the wire routing path. A known automatic wiring machine can be used for this wire routing operation. In FIG. 32, portions of the wire 110 that form the independent wires 111 to 116 are shown by the lines and portions of the wire 110 that form the common wires 121 to 126 are shown by heavy lines. The wire portions shown by fine lines and heavy lines are necessary wire portions. The remaining wire portions shown by dotted lines are unnecessary or surplus wire portions 110*a*.

As shown in FIG. 32, generally rod-like auxiliary guides 181 to 192 are positioned around the connector block body 130. Similar to the second and fourth embodiments, the auxiliary guides 181 to 192 are vertically disposed on a work support base of the automatic wiring machine (not shown). The auxiliary guide 181 is disposed to the lower right of the common connecting terminal 158. The auxiliary guide 182 is disposed below the injector #6. The auxiliary guide 183 is disposed above the independent connecting terminals 155, 156. The auxiliary guide 184 is disposed below the injector #5. The auxiliary guide 185 is disposed below the injector #4. The auxiliary guide 186 is disposed above the independent connecting terminal 154. The auxiliary guide 187 is disposed to the lower left of the common connecting terminal 158. The auxiliary guide 188 is disposed below the injector #1. The auxiliary guide 189 is disposed above the independent connecting terminals 151, 152. The auxiliary guide 190 is disposed below the injector #2. The auxiliary guide 191 is disposed below the injector #3. The auxiliary guide 192 is disposed above the independent connecting terminal 153.

As shown in FIG. 32, the wire 110 is routed from a starting point S of the auxiliary guide 181 back to an ending point E of the auxiliary guide 181, passing through the external wiring common connecting terminal 158, the common connecting terminal 106*b* of the injector #6, the auxiliary guide 182, the independent connecting terminal 106*a* of the injector #6, the independent connecting terminal 156, the auxiliary guide 183, the independent connecting terminal 155, the independent connecting terminal 105*a* of the injector #5, the auxiliary guide 184, the common connecting terminal 105*b* of the injector #5, the common connecting terminal 158, the common connecting terminal 104*b* of the injector #4, the auxiliary guide 185, the independent connecting terminal 104*a* of the injector #4, the independent connecting terminal 154, the auxiliary guide 186, the auxiliary guide 187, the common connecting terminal 158, the common connecting terminal 101*b* of the injector #1, the auxiliary guide 188, the independent connecting terminal 101*a* of the injector #1, the independent connecting terminal 151, the auxiliary guide 189, the independent connecting terminal 152, the independent connecting terminal 102*a* of the injector #2, the auxiliary guide 190, the common connecting terminal 102*b* of the injector #2, the common connecting terminal 158, the common connecting terminal 103*b* of the injector #3, the auxiliary guide 191, the independent connecting terminal 103*a* of the injector #3, the independent connecting terminal 153 and the auxiliary guide 192 in this order. During the wire installation process, the wire 110 is installed using a predetermined tension while being wound around or hooked on the wire guides (not shown).

Subsequently, in the wire connecting step, the wire 110 is connected to the connecting terminals 101*a*, 102*a*, 103*a*, 104*a*, 105*a*, 106*a*, 101*b*, 102*b*, 103*b*, 104*b*, 105*b*, 106*b*, 151 to 156, 158 by soldering, ultrasonic deposition, resistance welding or similar processes.

Subsequently, in the wire removal step, the unnecessary or surplus wire portions 110*a* are removed or cut out by a cutting device in the automatic wiring machine (not shown), which unnecessary or surplus wire portions 110*a* are portions of the wire 110 other than the necessary wire portions (the independent wires 111 to 116 and the common wires 121 to 126) that are connected between the independent connecting terminals 101*a*, 102*a*, 103*a*, 104*a*, 105*a*, 106*a* and the common connecting terminals 101*b*, 102*b*, 103*b*, 104*b*, 105*b*, 106*b* of the injectors #1 to #6 and the independent connecting terminals 151 to 156 and the common connecting terminal 158 of the external wiring connector 150. Thus, the wire installation of the wires 111 to 116, 121 to 126 with respect to the connector block body 130 is completed. The main body, wire distribution enclosure and ports for receiving the injector for each of the representative embodiments may preferably be integrally formed using injection molding techniques that are well known in the art, for example, in Japanese Patent Publication No. 4-263913.

The present teachings are not limited to the constructions that have been described as the representative embodiments, but rather, may be added to, changed, replaced with alternatives or otherwise modified without departing from the spirit and scope of the invention. For example, the present teachings may also be applied to engines having a different number of cylinders. The wire guides may also be fixed to the connector block body, for example, by a nail. The number, location and shape of the wire guides and the auxiliary guides are not limited. A plurality of wiring guides may be provided as one set and the wires may be wound around the wire guides more than one turn. The wire guides around which the wires are wound include wire guides that do not change the wiring direction of the wires. The auxiliary guides are not required if not necessary. Wiring guides may be provided in the connector block body as a substitute for the auxiliary guides. The injectors are not required to be arranged in a row. The connecting terminals of the connector connecting portions are not required to be arranged in a row. Instead of mounting a cover to cover the wire distribution enclosure 20, the fuel delivery pipe may also be completed by filling a potting resin in the wire distribution enclosure 20 of the main body 10. The wires are not required to be laid in generally the same plane as long as the wires do not cross each other. Further, although this invention has been described with respect to the fuel delivery pipe incorporating a connector block body, it may also be constructed as a connector block for injectors. Finally, fuel delivery pipes may be modified according to the teachings of U.S. Pat. No. 5,735,247, which is hereby incorporated by reference in its entirely.

What is claimed is:

1. An apparatus adapted to deliver fuel from a fuel supply to a plurality of fuel injectors, comprising:

a main body having a fuel passage defined therein, a wire distribution enclosure integrally disposed on the main body and having a plurality of wiring guides, wherein the wire distribution enclosure is substantially hollow, an external wiring connector disposed on the main body and having a plurality of connecting terminals, a plurality of ports disposed on the main body and adapted to receive fuel injectors, the ports each having connecting terminals and a plurality of wires wound around the wiring guides within the wire distribution enclosure and coupling the connecting terminals of the external wiring connector to the respective port connecting terminals.

2. An apparatus as set forth in claim 1, wherein the wires are hooked on the wire guides.

3. An apparatus as set forth in claim 1, wherein the wire guides are disposed in a position to change the routing direction of the wires.

4. An apparatus as set forth in claim 1, wherein each of the wire guides has a wire retainer.

5. An apparatus as set forth in claim 1, wherein each of the wires passes across at least one of the connecting terminals.

6. An apparatus as set forth in claim 1, further comprising at least one partition that separates the wire distribution enclosure into at least two sections.

7. An apparatus as set forth in claim 6, wherein the wires are separately installed in each of the sections of the wire distribution enclosure separated by the at least one partition.

8. An apparatus as set forth in claim 1, wherein the connecting terminals of the external wiring connector are press-fitted in the connector.

9. An apparatus as set forth in claim 1, wherein a surrounding wall is provided to enclose the wire distribution enclosure.

10. An apparatus as set forth in claim 9, wherein the connecting terminals of the injectors extend through the surrounding wall.

11. An apparatus as set forth in claim 9, wherein the surrounding wall has grooves for receiving the wires across the surrounding wall.

12. An apparatus as set forth in claim 1, wherein the wires do not cross each other.

13. An apparatus as set forth in claim 12, wherein:

the connecting terminals of the external wiring connector comprise one external wiring common connecting terminal and a plurality of external wiring independent connecting terminals, the number of external wiring independent connecting terminals corresponding to the number of injectors, the connecting terminals of each of the injectors comprise an injector independent connecting terminal and an injector common connecting terminal, each of the wires connected to the injector independent connecting terminals is connected to an associated one of the external wiring independent connecting terminals, and at least one of the wires connected to the common connecting terminals is connected from the injector side to the external wiring common connecting terminal and the other wires are routed from the side opposite to the injector side and connected to the external wiring common connecting terminal.

14. An apparatus as set forth in claim 1, further comprising a surrounding wall that encloses the wire distribution enclosure, a wire retainer disposed on each wire guide and at least one partition that separates the wire distribution enclosure into sections, wherein the wires are separately installed in each of the sections of the wire distribution enclosure and the wires do not cross each other.

15. An apparatus as set forth in claim 14, wherein the connecting terminals of the injectors extend through the surrounding wall.

16. An apparatus as set forth in claim 15, wherein the wire guides are disposed in a position to change the routing direction of the wires.

17. An apparatus as set forth in claim 16, wherein:

the connecting terminals of the external wiring connector comprise one external wiring common connecting terminal and a plurality of external wiring independent connecting terminals, the number of external wiring independent connecting terminals corresponding to the number of injectors, the connecting terminals of each of the injectors comprise an injector independent connecting terminal and an injector common connecting terminal, each of the wires connected to the injector independent connecting terminals is connected to an associated one of the external wiring independent connecting terminals, and at least one of the wires connected to the common connecting terminals is connected from the injector side to the external wiring common connecting terminal and the other wires are routed from the side opposite to the injector side and connected to the external wiring common connecting terminal.

18. A method of installing a plurality of electrical connections in a fuel delivery pipe having a plurality of injector connecting terminals, an external wiring connector having a plurality of connecting terminals, a main body having a wire distribution enclosure comprising a plurality of wiring guides and a plurality of wires disposed within the wire distribution enclosure that connect injector connecting terminals to respective connecting terminals of the external wiring connector, the method comprising:

routing a single wire along a wire routing path around the plurality of wiring guides, connecting the wire to the respective connecting terminals and removing portions of the wire that do not provide appropriate connections between the injector connecting terminals and the respective connecting terminals of the external wiring connector, thereby creating the plurality of wires.

19. A method as set forth in claim 18, wherein auxiliary guides are disposed around the fuel delivery pipe and the wire is routed around the auxiliary guides and the wire guides in the wire routing step.

20. A method as in claim 19, wherein the wire routing step is performed in a single continuous operation.

21. A method of installing a plurality of electrical connections in a fuel delivery pipe having a plurality of injector ports, each injector port having one injector independent connecting terminal and one injector common connecting terminal, an external wiring connector having one external wiring common connecting terminal and a plurality of external wiring independent connecting terminals that correspond in number to the number of injector ports, a plurality of wires that connect the injector independent connecting terminal and the injector common connecting terminal of each of the injectors to the external wiring common connecting terminal and the external wiring independent connecting terminals of the external wiring connector, and wiring guides, the method comprising:

routing a single wire along a wire routing path around the plurality of wiring guides, through the injector independent connecting terminal and the injector common connecting terminal of each of the injectors, and the external wiring common connecting terminal and the external wiring independent connecting terminals of the external wiring connector, connecting the wire to the connecting terminals and removing unnecessary portions of the wire, thereby creating the plurality of wires.

22. A method as set forth in claim 21, wherein auxiliary guides are disposed around the fuel delivery pipe and the wire is routed around the auxiliary guides and the wire guides, such that the wire passes across at least one of the connecting terminals of the injectors and the connecting terminals of the external wiring connector in the wire routing step.

23. A method as in claim 22, wherein the wire routing step is performed in a single continuous operation.

24. An apparatus adapted to deliver fuel from a fuel supply to a plurality of fuel injectors, comprising:

a main body having a fuel passage defined therein, a wire distribution enclosure integrally disposed on the main body and having a plurality of wiring guides, wherein the wiring guides are disposed in a position to change the routing direction of the wires, and wherein the wire distribution enclosure is substantially, hollow, an external wiring connector disposed on the main body and having a plurality of connecting terminals, a plurality of ports disposed on the main body and adapted to receive fuel injectors, the ports each having connecting terminals and a plurality of wires disposed around the wiring guides within the wire distribution enclosure and coupling the connecting terminals of the external wiring connector to the respective port connecting terminals.

25. An apparatus adapted to deliver fuel from a fuel supply to a plurality of fuel injectors, comprising:

a main body having a fuel passage defined therein, a wire distribution enclosure integrally disposed on the main body and having a plurality of wiring guides, wherein the wiring guides have a wall-like configuration and partition the wire distribution enclosure into sections, and wherein the wire distribution enclosure is substantially hollow, an external wiring connector disposed on the main body and having a plurality of connecting terminals, a plurality of ports disposed on the main body and adapted to receive fuel injectors, the ports each having connecting terminals and a plurality of wires disposed around the wiring guides within the wire distribution enclosure and coupling the connecting terminals of the external wiring connector to the respective port connecting terminals.

26. An apparatus adapted to deliver fuel from a fuel supply to a plurality of fuel injectors, comprising:

a main body having a fuel passage defined therein, a wire distribution enclosure integrally disposed on the main body and having a plurality of wiring guides, wherein the wire distribution enclosure is substantially hollow, a surrounding wall having grooves for receiving the wires across the surrounding wall is provided to enclose the wire distribution enclosure, an external wiring connector disposed on the main body and having a plurality of connecting terminals, a plurality of ports disposed on the main body and adapted to receive fuel injectors, the ports each having connecting terminals and a plurality of wires disposed around the wiring guides within the wire distribution enclosure and coupling the connecting terminals of the external wiring connector to the respective port connecting terminals.

27. An apparatus adapted to deliver fuel from a fuel supply to a plurality of fuel injectors, comprising:

a main body having a fuel passage defined therein, a wire distribution enclosure integrally disposed on the main body and having a plurality of wiring guides, wherein the wire distribution enclosure is substantially hollow, an external wiring connector disposed on the main body and having a plurality of connecting terminals, a plurality of ports disposed on the main body and adapted to receive fuel injectors, the ports each having connecting terminals and a plurality of wires disposed around the wiring guides within the wire distribution enclosure and coupling the connecting terminals of the external wiring connector to the respective port connecting terminals, and the wires do not cross each other, and wherein the plurality of connecting terminals comprise one external wiring common connecting terminal and a plurality of external wiring independent connecting terminals, the number of external wiring independent connecting terminals corresponding to the number of fuel injectors, the connecting terminals of each of the injectors comprise an injector independent connecting terminal and an injector common connecting terminal, each of the wires connected to the injector independent connecting terminals is connected to an associated one of the external wiring independent connecting terminals, and at least one of the wires connected to the common connecting terminals is connected from the injector side to the external wiring common connecting terminal and the other wires are routed from the side opposite to the injector side and connected to the external wiring common connecting terminal.

28. An apparatus adapted to deliver fuel from a fuel supply to a plurality of fuel injectors, comprising:

a main body having a fuel passage defined therein, a wire distribution enclosure integrally disposed on the main body and having a plurality of wiring guides, wherein the wire distribution enclosure is substantially hollow, an external wiring connector disposed on the main body and having a plurality of connecting terminals, a plurality of ports disposed on the main body and adapted to receive fuel injectors, the ports each having connecting terminals and a plurality of wires disposed around the wiring guides within the wire distribution enclosure and coupling the connecting terminals of the external wiring connector to the respective port connecting terminals, and a surrounding wall that encloses the wire distribution enclosure and a wire retainer disposed on each wiring guide, wherein the wiring guides partition the wire distribution enclosure into section, the wires are separately installed in each of the sections of the wire distribution enclosure and the wires do not cross each other.

* * * * *